United States Patent [19]

Groner

[11] 3,976,485

[45] Aug. 24, 1976

[54] PHOTOIMMOBILIZED ELECTROPHORETIC RECORDING PROCESS

[75] Inventor: Carl F. Groner, Rochester, N.Y.

[73] Assignee: Eastman Kodak Company, Rochester, N.Y.

[22] Filed: Aug. 25, 1975

[21] Appl. No.: 607,650

Related U.S. Application Data

[63] Continuation-in-part of Ser. No. 510,848, Sept. 30, 1974, abandoned, which is a continuation-in-part of Ser. No. 425,044, Dec. 14, 1973, abandoned.

[52] U.S. Cl. ..... 96/1.2; 96/1 PE; 96/1.3; 204/181; 355/3 P; 355/4

[51] Int. Cl.[2] ..... G03G 17/04

[58] Field of Search ..... 96/1 PE, 1.3, 1.2; 204/181 PE

[56] References Cited

UNITED STATES PATENTS

| | | | |
|---|---|---|---|
| 3,511,651 | 5/1970 | Rosenberg | 96/1.5 |
| 3,535,221 | 10/1970 | Tulagin | 96/1 PE X |
| 3,595,771 | 7/1971 | Weigl | 204/181 PE |
| 3,616,398 | 10/1971 | Jelfo | 204/181 PE X |
| 3,647,660 | 3/1972 | Wells | 204/181 PE |
| 3,664,941 | 5/1972 | Jelfo | 204/181 PE |
| 3,681,064 | 8/1972 | Yeh | 96/1 PE |
| 3,689,399 | 9/1972 | Ota | 96/1 PE X |
| 3,689,400 | 9/1972 | Ota et al. | 96/1 PE X |
| 3,767,392 | 10/1973 | Ota | 96/1 PE |
| 3,804,620 | 4/1974 | Wells | 96/1.3 |
| 3,850,627 | 11/1974 | Wells et al. | 96/1 PE X |
| 3,877,934 | 4/1975 | Schmidlin | 96/1.3 X |
| 3,901,696 | 8/1975 | Mohn et al. | 96/1 PE |

FOREIGN PATENTS OR APPLICATIONS

| | | | |
|---|---|---|---|
| 1,354,798 | 5/1974 | United Kingdom | 96/1.3 |

*Primary Examiner*—David Klein
*Assistant Examiner*—John R. Miller
*Attorney, Agent, or Firm*—John R. Everett

[57] ABSTRACT

An electrophoretic migration imaging process, apparatus, and materials useful therein are disclosed. Electrically photosensitive particles, at least some of which bear a positive polarity electrostatic charge, are disposed between two spaced electrodes. One of the electrodes has the surface thereof adjacent to the electrically photosensitive particles bearing a uniform layer containing an amount of a dark charge exchange material sufficient to provide a net change in charge polarity with at least a portion of said positive polarity particles upon electrical contact therewith in the presence of an electric field and in the absence of activating radiation. Imaging is accomplished by a. disposing the electrically photosensitive particles between the spaced electrodes, and b. substantially simultaneously 1. establishing a potential difference between said electrodes to create an electric field such that at least a portion of the positive polarity electrically photosensitive particles move into electrical contact with the layer of dark charge exchange material, and imagewise exposing the electrically photosensitive particles to activating radiation such that at least a portion of the exposed, positive polarity particles are immobilized at the surface of the layer of dark charge exchange material and at least a portion of the unexposed, positive polarity particles undergo a net change in charge polarity upon electrical contact with the layer of dark charge exchange material and are repelled therefrom.

38 Claims, 18 Drawing Figures

PHOTOIMMOBILIZED ELECTROPHORETIC RECORDING PROCESS

This application is a continuation-in-part of U.S. Ser. No. 510,848 filed Sept. 30, 1974 (now abandoned) which in turn is a continuation-in-part of U.S. Ser. No. 425,044 filed Dec. 14, 1973 (now abandoned).

FIELD OF THE INVENTION

This invention relates to electrophoretic migration imaging, and in particular to Photo Immobilized Electrophoretic Recording, often referred to hereinafter by the acronym PIER.

BACKGROUND OF THE INVENTION

In the past there has been rather extensive description of electrophoretic migration imaging processes. In these processes, as set forth in Sugarman, U.S. Pat. No. 2,758,939 issued Aug. 14, 1956, a layer of photoconductive particles, that is, electrically photosensitive particles, is subjected to the influence of an electric field between two spaced electrodes, at least one of which is transparent, and is exposed to a light image. As a result, those particles which are in electrical contact with an electrode during light exposure undergo a net change in charge polarity and migrate or are attracted to the adjacent spaced electrode having the opposite polarity, whereas the particles which are not exposed to light retain their original charge polarity. Thus, by producing an imagewise change in the charge polarity of the exposed photoconductive particles, photoconductive particle images may be formed at or near the surfaces of one or both of the two spaced electrodes which correspond to the original light image. According to one embodiment of the Sugarman process, the electrode surface at which the exposed electrically photosensitive particles undergo a net change in charge polarity is transparent and electrically conductive and the other spaced electrode surface bears a thin electrically insulating layer (sometimes referred to as a "blocking" layer) to prevent or at least reduce charge exchange with the electrically photosensitive particles.

Since the publication of the above-described electrophoretic migration imaging process appearing in U.S. Pat. No. 2,758,939, a number of other publications have appeared relating to the electrophoretic migration imaging process described by Sugarman. These publications include, for example, Uhrig, British Pat. No. 950,297 published Feb. 26, 1964, a series of U.S. patents by E. K. Kaprelian including No. 2,940,847 issued June 14, 1960; No. 3,100,426 issued Aug. 13, 1963; No. 3,140,175 issued July 7, 1964; and No. 3,143,508 issued Aug. 4, 1964. More recently, a number of other publications have appeared relating to the electrophoretic migration imaging process described by Sugarman, Uhrig, and Kaprelian such as Tulagin et. al. U.S. Pat. No. 3,384,565 issued May 21, 1968; Tulagin et. al. U.S. Pat. No. 3,615,558 issued Oct. 26, 1971; Clark, U.S. Pat. No. 3,384,566 issued May 21, 1968; Yeh U.S. Pat. No. 3,383,993 issued May 21, 1968; Jelfo, U.S. Pat. No. 3,616,398 issued Oct. 26, 1971; Wells, U.S. Pat. No. 3,647,660, issued Mar. 7, 1972; and Walsh, Canadian Pat. No. 899,137 issued May 2, 1972. These known electrophoretic migration imaging processes of the type described by Sugarman, Uhrig, and Kaprelian are often referred to herein as PhotoElectroPhoretic processes or the acronym PEP.

To applicant's knowledge, in known PEP processes the exposed photosensitive particles which are in electrical contact with an electrode, sometimes referred to as an "injecting" electrode, undergo a net change in their charge polarity to produce photosensitive particles of one polarity in exposed image areas while the unexposed photosensitive particles having an opposite polarity remain in non-image or dark areas. As a result, the photosensitive particles in the exposed areas which undergo a net change in charge polarity migrate or are attracted under the influence of the electric field to the spaced electrode having the opposite polarity, and the unexposed photosensitive particles which retain their original charge polarity migrate or are attracted to the other spaced electrode.

As suggested above, a primary difficulty encountered in PEP processes known to applicant is that in these processes it is the exposed photosensitive particles which undergo a net change in charge polarity. In many situations, however, it would be desirable to cause the unexposed particles to undergo a net change in charge polarity. If this could be done, it would be possible to obtain images having a reverse image snese in comparison to the images typically formed in known PEP processes.

As described in Jelfo, U.S. Pat. No. 3,616,398, issued Oct. 26, 1971 (at col. 1, lines 34–42), Wells, U.S. Pat. No. 3,647,660, issued Mar. 7, 1972 (at col. 1, lines 48–54), and Walsh, Canadian Pat. No. 899,137 issued May 2, 1972 (at page 2, line 24 – pg. 3, line 14), in conventional PEP monochrome and multicolor processes, acceptable imaging has been found to be generally restricted to a single sense process so that with positive input a negative image is produced and vice versa.

The processes described in the Jelfo and Wells patents referenced above attempt to overcome the above-described image sense restrictions encountered in conventional PEP monochrome processes. However, the processes described by Jelfo and Wells for attempting to provide image sense reversal in known PEP processes are quite restricted in their applicability because these processes require, at the very least, the addition of either beta-carotene, a vitamin precursor, or a halogen to the admixture of photosensitive particles used in these processes.

The process described in the Walsh Canadian patent referenced above attempts to overcome the above-described image sense restrictions encountered in conventional multicolor PEP processes by improving the quality of the color image formed on the electrode surface opposite the injecting electrode used in conventional PEP multicolor processes. According to the Walsh Canadian patent this may be done by attempting to eliminate or at least reduce the number of "undesired" photosensitive particles which are present in conventional multicolor PEP processes due to the bipolar properties of these particles.

As will be apparent from the disclosure of the Jelfo, Wells, and Walsh patents, the particle migration mechanism which occurs in the processes described by Jelfo, Wells, and Walsh does not differ from known PEP processes. That is, in the PEP processes described by Jelfo, Wells, and Walsh as in conventional PEP processes, it is the exposed photosensitive particles which undergo a net change in charge polarity whereas the unexposed particles retain their original charge polarity.

Thus, the basic exposure and charge exchange mechanism undergone by the exposed and unexposed electrically photosensitive particles, respectively, employed in the Jelfo, Walsh, and Wells processes is essentially the same as that of conventional PEP processes. Accordingly, the attempts of Jelfo, Walsh, and Wells to achieve image sense reversal of conventional PEP processes in no way provide an electrophoretic migration imaging process wherein the unexposed particles are caused to undergo a net change in charge polarity.

SUMMARY OF THE INVENTION

In accord with the present invention a photoimmobilized electrophoretic recording (PIER) process, apparatus, and materials useful in the same have been discovered. It has now been found that when electrically photosensitive particles, at least some of which bear a positive polarity electrostatic charge, are disposed between two spaced electrodes having the properties described hereinafter, subjected to an electric field, and imagewise exposed to activating electromagnetic radiation, image formation can be achieved by immobilizing at least a portion of the exposed photosensitive particles and causing at least a portion of the unexposed particles to undergo a net change in charge polarity.

In accord with the invention one of the two spaced electrodes has the surface thereof adjacent the photosensitive particles bearing an amount of a dark charge exchange material sufficient to provide a net change in charge polarity of at least a portion of the photosensitive particles bearing a positive polarity electrostatic charge upon electrical contact therewith in the presence of a field and in the absence of activating radiation. (This surface is sometimes referred to hereinafter as a dark charge exchange layer). The other spaced electrode may also have a dark charge exchange layer, or it may have a conductive surface or, advantageously, it may have on the surface thereof adjacent the photosensitive particles a "blocking" layer, i.e., a layer which under normal process imaging conditions exhibits minimal charge exchange capability with either the exposed or unexposed electrically photosensitive particles. Also, to facilitate exposure, it is preferred (but not required) that at least one of the two spaced electrodes be at least partially transparent to the activating radiation. The electrically photosensitive particle image which is formed in accord with the present invention is accomplished by (1) disposing electrically photosensitive particles, at least some of which bear a positive polarity electrostatic charge, between the spaced electrodes and (2) substantially simultaneously (a) establishing a potential difference between the two spaced electrodes to create an electric field such that at least a portion of the positive polarity photosensitive particles which are disposed between the electrodes move into electrical contact with the electrode bearing the dark charge exchange layer and (b) exposing the particles to an image pattern of activating radiation such that at least a portion of the exposed, positive polarity particles are immobilized at or near the surface of the dark charge exchange layer and at least a portion of the unexposed, positive polarity particles, upon electrical contact with said dark charge exchange layer, undergo a net change in charge polarity and are repelled therefrom.

In accord with an especially useful embodiment of the invention, the exposed photosensitive particles are immobilized at or near the surface of the dark charge exchange layer and form a negative appearing image of the original image; while the unexposed articles, upon electrical contact with the dark charge exchange layer, undergo a net change in charge polarity and are repelled from the dark charge exchange layer toward the adjacent electrode surface where they may form a positive appearing image of the original image.

In accord with various useful embodiments of the invention, the electrically photosensitive particles may be disposed between the two spaced electrodes in a liquid imaging suspension comprising an electrically insulating liquid. Upon being admixed in such a liquid, the particles acquire an electrostatic charge. Many particles as a result of incorporation in such a liquid vehicle tend to acquire a positive polarity electrostatic charge although it is not uncommon for the imaging suspension to contain a mixture of both positive and negative polarity particles. Advantageously, to improve the charge and dispersion stability of the liquid imaging suspension, various charge control agents, may also be incorporated in the imaging suspension.

In accord with another embodiment of the invention, it has been found that PIER is especially effective in providing a multicolor image using a mixture of at least two differently colored photosensitive particles, each of which is primarily responsive to activating radiation of a different wavelength. In this regard, it has been found that multicolor images produced by PIER using subtractive color formation advantageously exhibit good to excellent reproduction of neutral color tones. Furthermore, to date, it has been applicant's experience that PIER generally provides multicolor images exhibiting higher color density and better color separation than comparable PEP multicolor imaging processes. In addition, it has been found, for reasons not yet fully understood, that the electrically photosensitive particles employed in multicolor imaging suspensions in both PIER and PEP multicolor processes advantageously tend to exhibit less deleterious particle interaction in PIER than in PEP.

A surprising an unexpected feature of the present invention, in contrast to PEP imaging processes such as those described in the Sugarman, Uhrig, Kaprelian, Tulagin et al., Jelfo, Wells, and Walsh patents noted previously herein, is that in PIER it is the unexposed electrically photosensitive particles which exchange charge with a dark charge exchange surface of an electrode thereby undergoing a net change in their charge polarity.

It is recognized that among the various known embodiments of conventional PEP processes, it has been proposed, at one time or another, to modify the customary surface characteristics of the so-called injecting electrode and/or the blocking electrode. For example, in British Pat. No. 1,193,276 published May 28, 1970 in examples V–IX thereof it is proposed to coat extremely small amounts of a "Lewis base" or a "Lewis acid", such as 2,4,7-trinitro-9-fluorenone, on one or the other of the electrode surfaces used in PEP process to increase the photographic speed of the PEP process. Similarly, in British Pat. No. 1,347,162 published Feb. 20, 1974 it is proposed to coat a photoconductive layer on the surface of a PEP injecting electrode in an attempt to modify various imaging characteristics of conventional PEP processes, such as photographic speed, $D_{max.}$, $D_{min.}$, image contrast, and spectral sensitivity. In Weigl, U.S. Pat. No. 3,616,390 issued Oct. 26, 1971 and Weigl U.S. Pat. No. 3,723,288 issued Mar. 27, 1973 it is proposed to use as a conductive injecting electrode a pre-illuminated photoconductive zinc oxide-binder coating applied to a conductive substrate. In Weigl, U.S. Pat. No. 3,595,771 issued July 27, 1971, it is proposed to use as the "blocking electrode" of a PEP process a photoconductive insulating coating such as a "charge transfer complex" of a non-photoconductive aromatic polycarbonate polymer and a Lewis acid, such as 2,4,7-trinitro-9-fluorenone, in an effort to remove accumulated electrostatic charge which may build up on a conventional highly insulating blocking electrode. In Ota and Ota et. al., U.S. Pat. Nos. 3,689,399 and 3,689,400 issued Sept. 5, 1972 it is suggested that one can coat an insulating layer on the injecting electrode as well as the blocking electrode of a PEP image display device. In addition, in British Pat. No. 1,341,690 published Dec. 28, 1971 it is proposed to coat on the surface of an injecting electrode of a PEP process a photoconductive layer, an electroluminescent layer over the photoconductive layer, and a transparent conducting layer over the electroluminescent layer so that exposure may be effected by using the photoconductive layer to selectively energize the electroluminescent layer which in turn emits radiation to expose the image-forming electrically photosensitive particles used in the process.

However, even in the "modified" PEP processes described in the various Weigl, Ota, Ota et al., and British patents referenced immediately above, it appears that it is the exposed electrically photosensitive particles which, upon contact with an electrode, undergo a net change in charge polarity by exchanging charge with this electrode and are then repelled therefrom (i.e., attracted to the adjacent electrode of opposite polarity). In contrast, in PIER it is the unexposed electrically photosensitive particles which undergo a net change in polarity at or near the surface of a dark charge exchange surfaced electrode while the exposed photosensitive particles are inhibited from such charge exchange.

DESCRIPTION OF THE PREFERRED EMBODIMENTS

The PIER discovery of the present invention may be subjected to numerous variations and modifications depending upon the ultimate result desired, the specific materials which may be preferred to obtain a particular result, the particular processing conditions used, and the like. Many different embodiments of the present invention are described herein. Of course, it is not possible to catalog all conceivable variations of the present invention in the present application and, therefore, the description set forth herein is illustrative and should not be regarded as limiting the present invention.

To illustrate at least in a diagrammatic sense the imaging sequence which occurs in PIER as opposed to the imaging sequence of a typical PEP imaging process, the following discussion with reference to FIGS. 1*a*–1*d* and 2*a*–2*d* is presented.

Figure 1A:
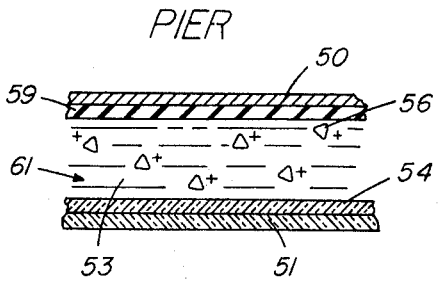
FIG. 1*a*–1*d* and 2*a*–2*d* are diagrammatic representations illustrating certain of the differences between a typical embodiment of PIER and a conventional PEP process, respectively.
Figure 2A:
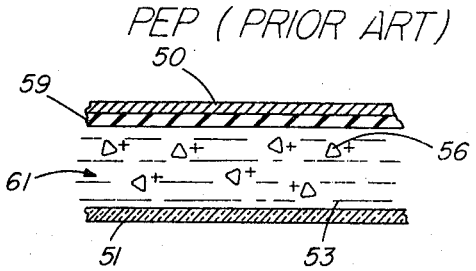

Referring now to FIG. 1*a* and FIG. 2*a*, there is illustrated a typical spaced electrode configuration for use in PIER and a PEP process, respectively. Both PIER and the PEP process use two spaced electrodes 50 and 51 between which is sandwiched a plurality of electrically photosensitive particles illustrated in FIG. 1*a* and FIG. 2*a* as a liquid imaging suspension 61 generally comprising an electrically insulating liquid 53 having dispersed therein electrically photosensitive particles 56 bearing an electrostatic charge. At least one of the electrodes in both the PIER and the PEP process illustrated in FIGS. 1*a*–*1d* and 2*a*–2*d* is at least partially transparent to activating radiation, for example, a conductive tin oxide coated glass electrode such as NESA glass (purchased from PPG Industries) may be used where the radiation is visible light. In this case, electrode 51 of FIG. 1*a* and FIG. 2*a* is partially transparent.

The term "activating radiation" as used herein is defined as radiation, including but not limited to electromagnetic radiation such as visible light, to which the electrically photosensitive particles used in PIER exhibit electrically photosensitive response, for example, the generation of electron-hole pairs. Typical activating radiation sources useful in PIER include conventional sources such as a tungsten lamp as well as sources such as a laser.

At least one of the electrodes in PIER, generally the transparent electrode if one is used, has coated on its interior surface adjacent the imaging suspension a layer of a dark charge exchange material 54. If, as is shown in FIG. 1*a*, the dark charge exchange layer 54 is coated on the partially transparent electrode 51 it is advantagesous that the dark charge exchange layer also be at least partially transparent to the activating radiation. In contrast, the partially transparent electrode of a typical PEP electrode configuration consists merely of a transparent conducting electrode such as NESA glass. In conventional PEP processes, electrode 51 is sometimes referred to as an injecting electrode. Electrode 50 bears layer 59 which contains a material exhibiting minimal charge exchange capability with the electrically photosensitive particles under normal process imaging conditions, for example, an electrically insulating material as described by Sugarman in U.S. Pat. No. 2,758,939 and, as noted earlier herein, may be referred to as a blocking layer.

Figure 1B:
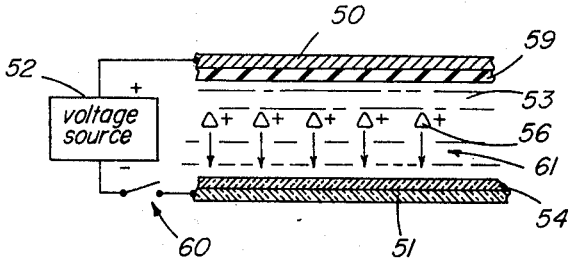
Figure 2B:
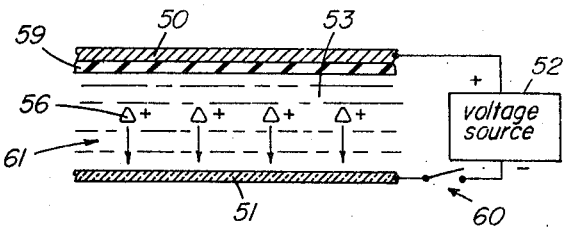

To illustrate some of the different functions and properties which distinguish PIER and PEP processes, a typical imaging sequence used in these two respective processes is illustrated in FIGS. 1*b*–1*d* and FIGS. 2*b*–2*d*, respectively. Referring now to FIGS. 1*b* and 2*b*, imaging may be initiated in both PIER and the PEP process by closing switch 60 to establish an electric field between electrodes 50 and 51 which are connected to voltage source 52. For convenience, in FIG. 1*b* and 2*b* it is assumed that the charge-bearing electrically photosensitive particles 56 disposed between electrodes 50 and 51 have associated with them a positive charge. It should be recognized, however, that imaging suspensions containing mixtures of both positively and negatively charge-bearing electrically photosensitive particles may be employed in the process of the present invention, provided that at least a portion of the particles bear a positive polarity electrostatic charge. In general, however, it is advantageous in PIER to use imaging suspensions which contain a substantial proportion of positively charged particles (i.e., greater than 40 percent, preferably a majority of said particles, and most advantageously 80 to 100 percent of said particles in said suspensions) to obtain better defined images and a more efficient image-forming process. Assuming that the electric field applied between electrodes 50 and 51 by the closing of switch 60 provides a negative potential on the dark charge exchange surface 54 of electrode 51 and a negative potential on electrode 51 of the PEP process, it is apparent that, upon application of this field, the positively charged photosensitive particles suspended in the carrier liquid will begin to electrophoretically migrate toward electrode 51 due to the forces of electrostatic attraction existing between these materials.

Figure 1C:
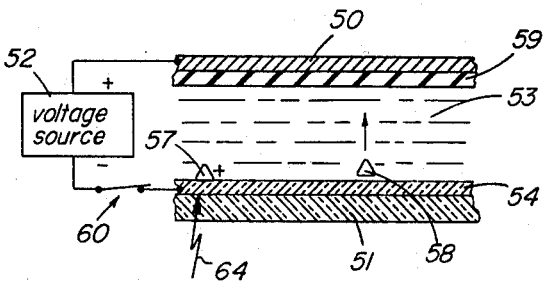
Figure 2C:
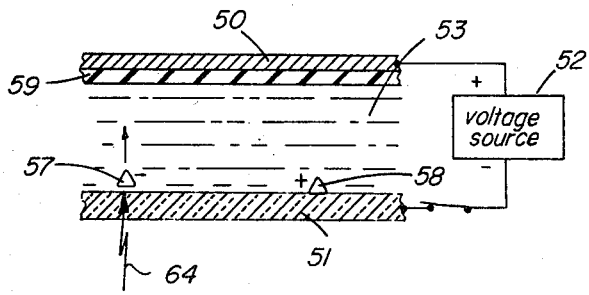

In a typical imaging operating in both the PIER and PEP imaging processes, an electric field is created between electrode 50 and 51, and during application of the field imagewise exposure 64 is effective through transparent electrode 51 as shown in FIG. 1*c* and 2*c*. Advantageously, the creation of the electric field and the imagewise exposure in PIER occur simultaneously.

It should be understood that the phase "substantailly simultaneously" as used herein to described the sequence of the electrical field application and exposure events between the spaced electrodes used in PIER includes any process sequence of field application and exposure events wherein the time of exposure coincides with a time in which the electrical field is present. As indicated above, to date, it has generally been found advantageous to apply the field and effect exposure simultaneously, at least insofar as this is technically possible. It will be appreciated, however, that, for example, with respect to a particular combination of electrode shapes and field application techniques or where it is desired to alter somewhat the normal response of the photosensitive particles in PIER, it may be desirable to create the field at some small, but finite, time before effecting imagewise exposure.

In PIER, referring now to FIG. 1*c*, as a result of exposure 64, positively charged electrically photosensitive particle 57 which comes into electrical contact with dark charge exchange layer 54 is immobilized and retained at the surface of dark charge exchange layer 54. On the other hand, positively charged electrically photosensitive particle 58 which is not exposed to activating radiation undergoes a net change in charge polarity upon electrical contact with dark charge exchange layer 54 to become negatively charged. Particle 58 is then repelled from the dark charge exchange layer and begins to migrate toward electrode 50 due to the electrostatic attraction existing between the now negatively charged electrically photosensitive particle 58 and the positive polarity of electrode 50.

The "electrical contact" which occurs in PIER between the dark charge exchange layer and the electrically photosensitive particles includes electrical contact between these materials occurring as a result of physical contact. However, it is believed that actual physical contact is not always necessary to establish electrical contact, close physical proximity sufficient to obtain current flow is all that is required. Accordingly, the term electrical contact used in the present specification and claims should not be limited to actual physical contact.

In contrast to PIER, the PEP process as illustrated in FIG. 2*c* appears to involve the following mechanism upon exposure to activating radiation: In the PEP process, positively charged electrically photosensitive particle 58 which is not exposed to activating radiation retains its original charge polarity upon electrical contact with transparent injecting electrode 51. As a result, unexposed particle 58 remains attracted to electrode 51 due to the electrostatic forces of attraction existing between positively charged particle 58 and the negative polarity of electrode 51. On the other hand, in the exposed areas, activating radiation 64 is transmitted through the transparent injecting electrode 51 and as positively charged electrically photosensitive particle 57 makes electrical contact therewith a net change in charge polarity of particle 57 does occur. Thus, in PEP the initially positively charged photosensitive particle 57 when subjected to exposure by activating radiation 64 undergoes a net change in charge polarity upon electrical contact with charge injecting surface 51 to become negatively charged and, as a result, is repelled from negative polarity injecting electrode 51 and migrates toward positive polarity electrode 50.

Figure 1D:
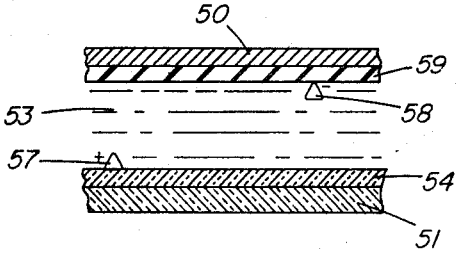
Figure 2D:
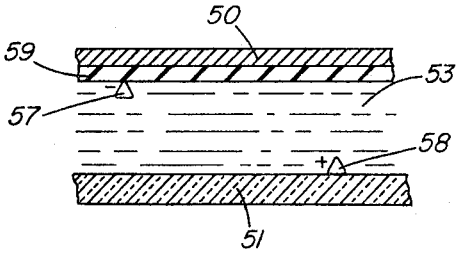

Based on the foregoing, as shown in FIG. 1*d*, PIER produces a positive-appearing image 58 on electrode 50 corresponding to the original image. In contrast, as shown in FIG. 2*d*, the PEP process produces a negative-appearing or reversal image 57 on electrode 50 corresponding to the original image.

Figure 3A:
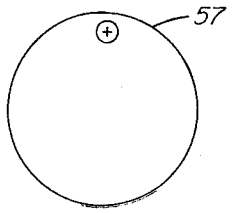
FIG. 3*a* and 3*b* are a diagrammatic representation of the exposure mechanism occurring in the electrically photosensitive particles used in the PIER process.
Figure 3B:
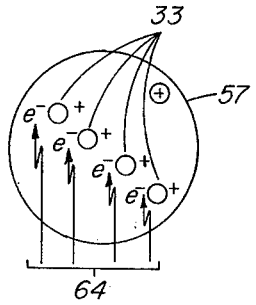

The precise theoretical explanation for PIER is not fully understood at present. However, so that one may better understand the electrical interaction which may be occurring in PIER, the following hypothesis is presented. Of course, this explanation, as indicated, is a hypothesis only. Accordingly, the present invention is not and should not be bound or limited thereby. The hypothesis to be considered herein is presented in terms of two cases: (1) the electrical interaction of an electrically photosensitive particle such as particle 57 in FIGS. 1*a*–1*d* with a layer of a dark charge exchange material in an electrode configuration as shown in FIGS. 1*a*–1*d*, and (2) the electrical interaction of an electrically photosensitive particle such as particle 58 of FIGS. 1*a*–1*d* with a dark charge exchange material in an electrode configuration as illustrated in FIGS. 1*a*–1*d*. The essential difference between these two cases being, of course, that particle 57 which initially bears a positive charge as it comes into electrical contact with the dark charge exchange layer is exposed to activating radiation, whereas particle 58 which also initially bears a positive electrostatic charge as it comes into contact with the dark charge exchange material is not exposed to activating radiation. As illustrated in FIGS. 3*a* and 3*b*, particle 57 which is exposed to activating radiation 64 has generated in it electron hole pairs 33, whereas no such electron hole pairs are generated in particle 58 because it is not exposed to activating radiation.

Turning now to the case of the unexposed particle, particle 58 of FIG. 1*a*–1*d*, it is hypothesized that as this positively charge unexposed particle comes into electrical contact with the dark charge exchange layer there is a flow of electrons from the dark charge exchange layer into the unexposed photosensitive particle 58. i.e. electrons are injected into unexposed particles 58. As a result, as unexposed particle 58 acquires a number of electrons, it begins to build up a number of negative charge units. At some point, the number of negative charge units acquired by particle 58 exceeds the magnitude of the original positive polarity electrostatic charge associated with particle 58, and particle 58 reverses its net charge polarity from positive to negative. Upon reversal of its charge polarity, particle 58 is repelled from the dark charge exchange layer which is coated on negative polarity electrode 51 and is attracted to positive polarity electrode 50.

Now the case relating to positively charged electrically photosensitive particle 57 of FIGS. 1*a*–1*d* which is exposed to activating radiation 64 as it comes into electrical contact with the dark charge exchange layer may be considered. In this case, as with unexposed particle 58, there is believed to be a flow of electrons from the dark charge exchange layer to the particle. However, unlike particle 58, exposure generates electron hole pairs in exposed particle 57 (as illustrated in FIG. 3*a* and 3*b* ) by exciting an electron from the valence band into the conduction band leaving behind a positive hole in the valence band. With respect to the electron hole pairs of exposed particle 57, the dark charge exchange layer is believed to act as a barrier to the flow of positive holes while permitting the flow of excited electrons.

As a result of the flow of electrons from the dark charge exchange layer to exposed particle 57 and the return flow of excited electrons to the dark charge exchange layer, there is little or no net accumulation of negative charge in exposed particle 57. Accordingly, exposed particle 57 which is initially positively charged retains its original positive charge; and exposed particle 57 is immobilized at the dark charge exchange layer due to the electrical attraction between the positively charged particle and the negative polarity electrode.

As is apparent, an essential feature of the present invention is the use of a dark charge exchange layer. It is this layer which enables charge exchange with the electrically photosensitive particles to occur in the absence of activating radiation. Materials which can be used as the dark charge exchange material in this layer may be selected from a variety of crystalline and amorphous materials including inorganic materials such as certain metals, organic materials, and organo-metallic materials.

Regardless of the specific composition of the dark charge exchange layer, the layer must be capable of exchanging charge with the electrically photosensitive particles used in the present invention in the absence of activating radiation in order to reverse the polarity of the unexposed particles.

One aid which is considered to be a useful guide for the selection of crystalline dark charge exchange materials, particularly inorganic materials having utility in PIER, may be illustrated with reference to Table 1. Table 1 lists representative "reported" work function values of various inorganic crystalline materials, i.e., materials exhibiting crystallinity detectable by conventional X-ray diffraction techniques. It is believed that inorganic crystalline materials which have an "effective" work function which is lower than the effective work function of the photosensitive particles used in PIER provide useful dark charge exchange materials. The terms "effective" work function and "reported" work function are used herein because as is well-known many of the methods for determining work functions of various materials are difficult to carry out and may be affected by numerous factors such as the purity of the material being measured, the physical treatment of a material, e.g., milling can alter the work function of a material, the physical and chemical surface properties of the material, e.g., whether the surface is clean, contaminated with impurities, or has a surface film such as an oxide film, polymer film, etc. It should be further noted that not all of the methods are of equivalent precision or accuracy, nor are they all equally suited for use for each different type of material or material surface. Thus, it will be appreciated that the reported work functions and energy levels of a given electrically photosensitive particle and inorganic crystalline material may differ markedly from their actual effective work functions when subjected to the environmental operating conditions of a specific PIER process. In fact, as is known, reported literature values of the work functions for the same material vary.

As suggested above, the relative values, not the absolute values, of the effective work function of the dark charge exchange material and the effective work function of the electrically photosensitive particle material are of primary concern. That is, one would select as an inorganic crystalline dark charge exchange material, an inorganic crystalline material which has a lower effective work function than the effective work function associated with the particular photosensitive particles intended for use.

With respect to specific inorganic crystalline materials which may be employed as dark charge layers, it is believed that crystalline materials, such as metals, having an effective work function of less than about 4 ev. are preferable for use in the invention. (See Table 1). These materials are believed useful because many of the known electrically photosensitive particles for example, phthalocyanine pigment particles, useful in the present invention appear to have a reported work function greater than about 4 ev. (See Table 1. ) As will be appreciated, the greater the difference between the effective work functions of an inorganic crystalline dark charge exchange material and a particular electrically photosensitive particle, the more efficient PIER should become.

Table 1*

| Material | Reported Work Function[f] |
|---|---|
| Rb | 2.05 |
| K | 2.1 |
| Na | 2.20 |
| Ba | 2.25 |
| Sr | 2.30 |
| Li | 2.35 |
| Pr | 2.60 |
| Ce | 2.60 |
| Ca | 2.70 |
| Sm | 3.1 |
| Nd | 3.2 |
| La | 3.2 |

Table 1*-continued

| Material | Reported Work Function[f] |
|---|---|
| Be | 3.25 |
| Th | 3.30 |
| Mg | 3.40 |
| Hf | 3.50 |
| Zn | 3.60 |
| Tl | 3.70 |
| Zr | 3.75 |
| Cd | 3.80 |
| In | 3.80[1] |
| Cb | 3.85 |
| Ga | 3.90 |
| Pb | 4.0 |
| Si | 4.05 |
| Sn | 4.10 |
| Sb | 4.10 |
| Ti | 4.15 |
| Co | 4.2 |
| Al | 4.2[1] |
| Ag | 4.25 |
| Bi | 4.25 |
| Fe | 4.30 |
| Cu | 4.50 |
| a phthalocyanine pigment | 4.50[2] |
| B | 4.55 |
| Ru | 4.55 |
| Hg | 4.60 |
| Ge | 4.65 |
| Os | 4.65 |
| Pd | 4.75 |
| Au | 4.8[1] |
| Ni | 4.80 |
| ZnO | 4.84[3] |
| As | 5.1 |
| Pt | 5.3[1] |

*All reported work function values are taken from Gordy and Thomas, J. Chem. Phys., Vol. 24, page 439 (1956), except where otherwise indicated

[f]The work function values in Table 1 are the values reported in various literature sources. As explained previously the "effective" work function of a material used in PIER is, in large part, dependent on the various milling procedures and other surface treatments such as various contaminants to which it is subjected. Accordingly, it should be recognized that the reported work function value of Table 1 may differ fairly substantially from the "effective" work function of the same material used in PIER.

[1]J. P. Mitchell and D. G. Denure, "Electrical Contacts on Photoconductive $Sb_2S_3$ Films", Thin Solid Films, Vol. 16, page 295, FIG. 7, (1973).

[2]Taken from H. Meier, Spectral Sensitization, The Focal Press, page 174, Table 19 (1968).

[3]Ib. at page 175, Table 19A.

In addition to the various inorganic crystalline dark charge exchange materials described above, it has been discovered in accord with other especially useful embodiments of the present invention that various organic, including organo-metallic, materials may also be employed as dark charge exchange materials. Organic materials have not, to date been extensively evaluated in the literature in terms of work function or relevant energy level measurements. However, one criterion which provides a useful guide for the selection of organic dark charge exchange materials is the finding that many electron acceptor materials, sometimes referred to as Lewis acid materials, particularly certain substituted aromatic, including substituted heterocyclic ring-containing materials possessing conjugated aromatic unsaturation in the heterocyclic rings thereof, provide useful dark charge exchange materials. For example, 2,4,7-trinitro-9-fluorenone, which is conventionally referred to as a Lewis acid material has been found especially useful in forming the dark charge exchange layers used in PIER.

Typical useful electron acceptor materials are substituted aromatic compounds containing one or more substituted aromatic rings. These substituted mono- and poly-cyclic aromatic materials may contain from about 4 to about 40 or more carbon ring atoms and, if hetero ring atoms are present, from 1 up to about 8 or more hetero atoms such as oxygen, sulfur, selenium and nitrogen atoms. The aforementioned materials are monomers. It will be appreciated, however, that polymers having repeating units containing such monomers may also be used.

In accord with the invention, electron acceptor materials which have been found especially useful as dark charge exchange materials may be characterized as follows: (a) the material contains at least one substituted aromatic ring, including substituted heterocyclic rings which possess conjugated aromatic unsaturation in the heterocyclic ring; and (b) the material has an electron acceptor strength, $\chi$, which is greater than about $-0.35$, ie., the material has a $\chi$ value more positive than about $-0.35$. The term "electron acceptor strength" as used herein, sometimes referred to in the literature simply as "acceptor strength", has reference to acceptor strength values of materials as determined by the method described by Dewar and coworkers in (1) M. J. S. Dewar and A. R. Lepley, J. Amer. Chem. Soc., Vol. 83, pg. 4560 (1961) and (2) M. J. S. Dewar and H. Rogers, ibid., Vol. 84, pg. 395 (1962). A further explanation of this method and a partial listing of acceptor strengths of compounds, certain of which have been found to be useful as dark charge exchange materials in PIER, may be found in T. Sulzberg and R. J. Cotter, J. Org. Chem., Vol. 35, No. 8, p. 2762 (1970), see Table III thereof.

The electron acceptor materials useful as dark charge exchange materials in PIER typically have as substituents on an aromatic ring thereof one or more strong electron withdrawing groups, ie., a substituent which is an electron accepting (electronegative) group. Typical of strong electron withdrawing groups are nitro groups; cyano groups; dicyanoalkylene groups such as dicyanomethylene; cationic amino groups, ie., $-NR_3^+$ wherein R represents hydrogen or an organo group such as an alkyl, e.g., methyl; sulfones such as $-SO_2R$ wherein R is as defined above; and the like.

It has been found that strong electron withdrawing groups especially useful in the invention are groups having positive Hammett sigma values greater than about 0.35; electron withdrawing groups having positive Hammett values greater than about 0.70, such as nitro groups, have been found particularly effective in the invention. Hammett sigma values for a variety of substituents for an aromatic nucleus can be determined by reference to the published literature or can be determined directly using procedures described in the literature. In accord with conventional practice, electron withdrawing groups are assigned positive sigma values while electron donating (electropositive) groups are assigned negative sigma values.

Sigma values for a given substituent of an aromatic nucleus may vary as a function of ring position. For example, a given substituent to a phenyl ring can exhibit one sigma value in the meta position and another when in the para position. Exemplary meta and para sigma values and procedures for their determination are set forth by H. Van Bekkum, P. E. Verkade and B. M. Webster in Rec. Trav. Chim., vol. 78, pg. 815, published 1959; by P. R. Wells in Chem. Revs., vol. 63, pg. 171, published 1963; by H. H. Jaffe, Chem. Revs., vol. 53, pg. 191, published 1953; by M. J. S. Dewar and P. J. Grisdale in J. Amer. Chem. Soc., vol. 84, pg. 3548, published 1962; and by Barlin and Perrin in Quart. Revs., vol. 20, pg. 75 et seq., published 1966. A partial list of illustrative Hammett sigma values for various common substituents of aromatic rings are set forth in Table 2.

Table 2*

Hammet Sigma Values ($\sigma_m$ and $\sigma_p$) for Substituents Attached to Aromatic Ring

| Substituent Group | $\sigma_m$ | $\sigma_p$ |
|---|---|---|
| $-CH_3$ | −0.07 | −0.17 |
| $-C_2H_5$ | −0.04 | −0.15 |
| $-C_6H_5$ | +0.06 | +0.01 |
| $-CF_3$ | +0.42 | +0.55 |
| $-OH$ | 0.00 | −0.46 |
| $-O^-$ | −0.71 | −0.52 |
| $-OCH_3$ | +0.12 | −0.27 |
| $-F$ | +0.34 | +0.06 |
| $-Cl$ | +0.37 | +0.23 |
| $-Br$ | +0.39 | +0.23 |
| $-I$ | +0.35 | +0.28 |
| $-NO_2$ | +0.71 | +0.78 |
| $-NH_2$ | −0.16 | −0.66 |
| $-N(CH_3)_3^{\oplus}$ | +0.91 | +0.86 |
| $-NH-\underset{\underset{O}{\|}}{C}-Ph$ | +0.22 | +0.08 |
| $-COOH$ | +0.36 | +0.27 |
| $-\underset{\underset{O}{\|}}{C}-O^{\ominus}$ | +0.10 | +0.13 |
| $-CHO$ | +0.38 | +0.22 |
| $-\underset{\underset{O}{\|}}{C}-CH_3$ | +0.31 | +0.52 |
| $-CN$ | +0.68 | +0.63 |
| $-SO_2CH_3^{\oplus}$ | +1.0 | +1.2[1] |

*All reported sigma values are taken from E. S. Gould, Mechanism & Structure in Organic Chemistry, published by Holt, Rinehart and Winston, page 221 (1959), except where otherwise indicated.
[1]Estimated Values Electron acceptor materials especially useful as dark charge exchange materials in the present invention include those aromatic compounds which contain two or more fused aromatic rings. A partial list of representative such compounds includes 2,4,7-trinitro-9-fluorenone; 9-(dicyanomethylene)-2,4,7-trinitrofluorene; 2,4,5,7-tetranitro-9-fluorenone; methyl-2,7-dinitro-9-fluorenone carboxylate; 2-dicyanomethylene-1,3-indandione; etc. Of course, as may be inferred from the aforementioned dark charge exchange materials, these materials may also contain one or more substituents in addition to the desired strong electron withdrawing groups. Such additional substituents may be selected from a wide variety of known substituent groups for arometic molecules.

Because of the diverse materials which have been found useful as dark charge exchange materials, the following simple "dark test" is presented for the selection and identification of dark charge exchange materials. The test is carried out in the dark, is relatively easy to conduct, employs commercially available materials, and involves only minimal costs:

1. First, the particular material to be tested as a dark charge exchange material is applied on a conductive, at least partially transparent support, such as the conductive tin oxide surface of a NESA glass plate, over a surface area, such as a square having dimensions of about 8 cm. by 8 cm., i.e., approximately 64 square centimeters. Of course, the material to be tested could be applied over a surface area other than an 8 cm × 8 cm square. This particular size was chosen herein simply as a matter of convenience. The material to be tested should be applied on the conducting support to form a uniform smooth layer of the material. If the material to be tested is, for example, an inorganic material, it may be conveniently applied, for example, by vacuum evaporation. If the material to be tested for dark charge exchange properties is not easily applied by itself, such as many of the above-noted organic materials; it may advantageously be admixed with a suitable film-forming binder such as a polymeric material, for example, a bisphenol polycarbonate such as Lexan 145, and a suitable liquid vehicle, preferably a liquid which is a solvent for both the binder and the material to be tested. The resultant dope may then be uniformly coated on the tin oxide surface of the NESA glass plate. After coating, the layer may be dried to remove by evaporation most or all of the liquid coating vehicle to form a smooth uniform layer suitable for testing. If the latter solvent coating method described immediately above is used, it should be recognized that the material to be tested for dark charge properties and binder may be admixed in the coating vehicle in varying amounts depending upon the compatibility of the particular binder and material to be tested. In this regard, it is noted that many materials when admixed in relatively small amounts with a binder are unsuitable for use as a dark charge exchange material; however, certain of these materials are quite effective dark charge exchange materials when larger amounts thereof are combined with the binder material.

2. Next, a liquid imaging suspension composed of the particular kind of photosensitive particles which are desired to be used in combination with the material to be tested for dark charge exchange properties is formulated. This is done simply by forming a suspension of the desired electrically photosensitive particles in an electrically insulating liquid such as an isoparaffinic hydrocarbon which is chemically inert with respect to the photosensitive particles. For example, because of its ready availability, Isopar G, a trademark of Exxon Corporation for an isoparaffinic hydrocarbon having a boiling point within the range of from about 145°C. to about 185°C, may be used as the electrically insulating liquid. The electrically photosensitive particles used in the suspension may be selected from a wide variety of known materials which are electrically photosensitive. (Greater detail concerning specific electrically photosensitive particles is presented hereinafter.) Of course, in any practical PIER imaging application, the particular photosensitive particles selected for use would be dependent on the particular wavelength of activating radiation which one desired to use. However, for purposes of the present test which is carried out in the dark, one need only be certain that the particular electrically photosensitive particles selected are substantially insensitive to any extraneous radiation which may be present in the test environment other than visible light radiation. For example, electrically photosensitive particles composed of the beta form of copper phthalocyanine, C. I. 74160, available from American Cyanamid under the tradename of Cyan Blue GTNF, have been found especially useful for testing the dark charge exchange properties of materials. In preparing the suspension of the electrically photosensitive particles in the electrically insulating liquid, it has generally been found that a liquid imaging suspension containing about 0.1 to about 1.0 weight percent of the electrically photosensitive particles dispersed therein may be used, each particle having an average particle size of within the range of from about 0.1 to about 3 microns. In addition, it has been found desirable to admix a charge control agent in the liquid imaging suspension to aid in stabilizing the suspension of the electrically photosensitive particles and to maximize the number of photosensitive particles having a positive polarity electrostatic charge. Piccotex 100, a tradename for a copolymer of styrene and vinyl toluene sold by Pennsylvania Industrial Chemical Corp. has been found useful as the charge control agent with Cyan Blue GTNF particles and many other electrically photosensitive particles responsive to visible light. Because it is desirable to have a "standard" suspension of electrically photosensitive particles to use in evaluating a series of materials to be tested for dark charge exchange properties and to optimize the total number of particles in the liquid imaging suspension which have a positive polarity, it is suggested that the test imaging suspension be prepared as follows:

Ballmilling at about 180 r.p.m. for about 4 weeks in 250 cubic centimeter brown glass bottles filled to one-half volume with stainless steel balls having a diameter of about 0.32 centimeters a composition which consists of 0.5 g. of Cyan Blue GTNF as the electrically photosensitive material selected for use and 150 g. consisting of a mixture composed of approximately equal parts by weight of Piccotex 100 and Isopar G. Milling is carried out in the dark, and the resultant suspension is stored in the dark until just prior to use.

Figure 8A:
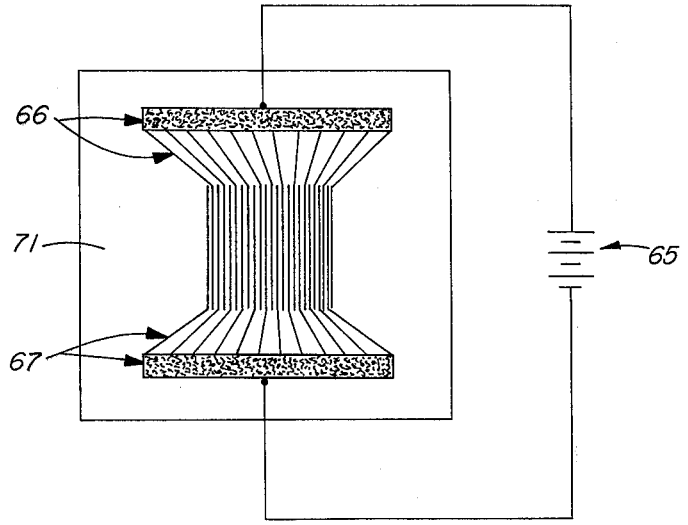
FIG. 8*a* is a top view of an interdigital electrode system and FIG. 8*b* illustrates diagrammatically a side view of an interdigital electrode configuration useful in evaluating various imaging suspensions which may be employed to test the dark charge exchange properties of a particular material.
Figure 8B:
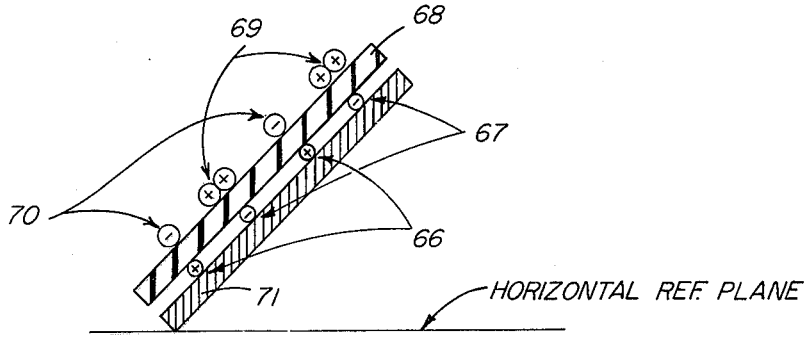

3. In carrying out the present test, it is necessary to use as the imaging suspension described in step (2) above a suspension in which at least 50 percent, and ideally all, of the electrically photosensitive particles dispersed therein have a positive polarity. If there are more negative polarity particles than positively charged particles present in the test imaging suspension, the results of the present test become difficult to interpret. For this reason, the particular imaging composition and its method of preparation described in step (2) above have been devised because this particular composition, when made as described, has been found to consistently provide a test suspension in which almost all the charged electrically photosensitive particles exhibit a positive polarity. Because of the importance of the charge polarity of the electrically photosensitive particles used in the present test, it is suggested that a polarity check be made of the liquid imaging suspension before it is employed in the present test. One convenient means for determining polarity of the liquid imaging suspensions employs an interdigital electrode configuration of the type shown in FIGS. 8*a* and 8*b* and discussed hereinafter as follows:

Referring to FIG. 8*a* and FIG. 8*b*, electrodes 66 and 67 are made from a NESA glass plate 71 by etching away the tin oxide surface between the electrodes so that no electrical contact is made between adjacent electrodes. A voltage source 65 is used to apply a positive potential to electrode 66 and a negative potential to electrode 67. A thin insulating layer 68 such as polyethylene terephthalate, eg., MYLAR sold by E. I. duPont de Nemours, shown in FIG. 8*b* is placed over the interdigital electrode configuration of FIG. 8*a*. Layer 68 serves as both a blocking layer to minimize charge exchange between the photosensitive pigment particles and the electrodes and a permanent record of the polarity test. The polarity testing procedure consists of applying an electrical potential 65 to the electrodes 66 and 67. Then, with the electrode arrangement shown in FIG. 8*b* held at about a 45° angle, approximately 1cc. of the imaging suspension to be evaluated is coated on the uppermost portion of layer 68 and allowed to flow uniformly over the surface of layer 68 which is directly above the underlying interdigital electrode configuration 66 and 67. As the suspended particles encounter the electric fields associated with the biased electrodes, any positively charged particles 69 will be electrostatically attracted to the negative electrodes 67 and any negatively charged particles 70 will be electrostatically attracted to the positive electrodes 66. By comparing the amount of particles which accumulate at the negative and positive electrodes, the relative number of positively and negatively charged particles in a given imaging suspension can be determined. For example, if only positive particles are present, all of the particles will accumulate on electrode 67 and no particle accumulation will be noted on electrode 66. The number of positively charged particles compared to the number of negatively charged particles present in any given imaging suspension may be approximated by comparing the optical density of the image pattern formed on layer 68 by the positively charged particles 69 (which pattern corresponds to the shape of negative polarity electrode 67) to the optical density of the image pattern formed by the negatively charged particles 70 (which pattern corresponds to the shape of positive polarity electrode 66). To a good approximation, the ratio of the optical densities of the patterns formed by particles 69 and 70 is equal to the ratio of the number of positively charged particles 69 to the number of negatively charged particles 70 present in the particular suspension being evaluated.

4. Next, a conductive metal roller is selected, such as an aluminum roller having a diameter of about 4.1 centimeters and a width of at least 8 cm. On the external surface of the conductive metal roller an electrically insulating coating is applied to serve as a blocking layer. This may be accomplished simply by taping a dielectric coated paper over the conducting roller. Suitable dielectric coated papers are readily obtainable. One such paper which is recommended for this dark test consists of a conductive paper support exhibiting a specific resistivity of about $10^9$ ohm - cm. at 50 percent R. H. and room temperature (i.e. about 21°C.), which paper support has coated thereon a layer of poly (vinyl butyral) resin (purchased under the tradename of Butvar B-76 from Shawinigan Products Corp.) at a dry thickness of about 10 microns.

5. The test is conducted in the dark, ie. in the absence of activating radiation or under appropriate safelight conditions, by applying about 0.3 ml. of the liquid imaging suspension prepared in step (2) as a thin uniform film over a freshly prepared 8 cm. by 8 cm. layer of the material to be tested for dark charge exchange properties coated on the NESA plate as described in step (1). The conductive metal roller bearing a blocking layer as described in step (4) is then biased to approximately +1.0 to about +1.5 kilovolts relative to the NESA plate bearing the coating of the material to be tested. The biased roller is then rolled across the NESA plate surface bearing the layer of the material to be tested and the film of liquid imaging suspension. The roller may be moved across the NESA plate mechanically or by hand at a speed of about 1.0 cm./sec.

6. Following step (5) above, the photosensitive particles which have migrated to and remain located on the 8 cm. by 8 cm. layer of the material being tested for dark charge exchange properties (which is coated on the NESA plate as described in step (1) are electrostatically transferred to the surface of a receiving sheet which is identical to the material used as a blocking layer in step (4), ie. a paper coated with a 10 micron thick layer of Butvar B-76. This can be done conveniently with a 1.0 to 2.0 kilovolt transfer potential. Ths resultant receiving sheet bearing the particles transferred from the surface of the material being tested coated on the NESA plate is referred to hereinafter as the "NESA plate transfer record". This electrostatic transfer should be carefully executed to insure there is a transfer of substantially all the particles located on the layer of the material being tested for dark charge exchange properties. The purpose of the transfer carried out in this step of the dark test is to provide an equivalent basis for comparing the optical density of the image created by the photosensitive particles which have migrated to and remain on the 8 cm. by 8 cm. layer of the material being tested (which is coated on the NESA plate as described in step (1)) to the optical density of the image created by the photosensitive particles which have migrated to and remain on the blocking layer of the conductive roller (as described in step (4)). The significance of this optical density comparison is described hereinafter. In making the optical density comparison noted in this step of the dark test, one should, of course, select areas of the NESA plate transfer record and areas of the blocking layer of the conductive roller which fairly represent the overall optical densities of these two surfaces. One convenient way of accomplishing this is to compare the optical density at a given area(s) of the image formed on the blocking layer of the conductive roller to the optical density at area(s) of the NESA plate transfer record which correspond to the area(s) selected on the blocking layer of the conductive roller.

After carrying out steps (1)–(6) of the above-described test, one can readily evaluate whether the material to be tested is a dark charge exchange material as follows: Specifically, if the material to be tested possesses dark charge exchange properties, then the electrically photosensitive particles of the liquid imaging suspension will form an 8 cm. by 8 cm. square solid area image on the blocking layer of the conductive roller (described in step (4) of the test) which corresponds to the 8 cm. by 8 cm. square layer of the material to be tested coated on the NESA plate (described in step (1) of the test); and this image formed in the dark on the blocking layer will have a higher optical density than any similar image which may also have been formed on the NESA plate transfer record. In contrast, if there is formed on the NESA plate transfer record a solid area image which has a higher optical density than the image formed on the blocking layer of the conductive roller, then conventional PEP operation is occurring, rather than PIER. In the latter case, the material tested is not a dark charge exchange material relative to the particular electrically photosensitive particles used in the liquid imaging suspension. For example, materials, such as tin oxide, provide conventional PEP operation when run through the above test using Cyan Blue GTNF as the photosensitive particles. Similarly, thin layers of electrically insulating materials such as poly(ethylene)terephthalate and Lexan polycarbonate provide conventional PEP operation when run through the above test using Cyan Blue GTNF as the photosensitive particles. Thus, it can be concluded that tin oxide and thin layers of poly(ethylene)terephthalate and Lexan polycarbonate possess no significant dark charge exchange properties relative to Cyan Blue GTNF particles.

As will be apparent, the above-described dark test is based on the PIER and PEP processes described hereinbefore with reference to FIGS. 1*a*–1*d* and FIGS. 2*a*–2*d*. That is, a material which exhibits dark charge exchange properties, as shown in FIG. 1*c*, will exchange charge with unexposed positive polarity electrically photosensitive particles so that these particles, merely by making electrical contact with the material being tested, will undergo a net change in charge polarity in the dark. Thus, a material which exhibits very strong dark charge exchange properties, when subjected to the above-described dark test, will effectively cause a net change in charge polarity of all or almost all the positively-charged electrically photosensitive particles with which it comes into electrical contact. As a result, these particles will be repelled from the surface of the material being tested and will be attracted to the adjacent, positive polarity, blocking electrode surface. (See FIG. 1*d*.) Therefore, a dense, clearly visible, solid area image formed by the unexposed photosensitive particles will be produced on the blocking layer of the roller electrode; and, ideally, little or no visible image will be formed on the NESA plate transfer record. If the material being tested for dark charge exchange properties is of intermediate strength, one will obtain, as a result of the above-noted dark test, visible images on both the blocking layer of the roller electrode and the NESA plate transfer record, however, the image formed on the blocking layer of the roller electrode will have the greater optical density. If the material being tested possesses little or no dark charge exchange capability, then one will obtain, as a consequence of the above-noted dark test, a conventional PEP result, namely a visible image on the NESA plate transfer record which has a greater optical density than any similar image which may also be formed on the blocking layer of the roller electrode.

To aid in forming a smooth, uniform layer of the dark charge exchange material, it has been found convenient in many cases to apply the dark charge exchange material to the surface of the electrode to be coated in admixture with a film-forming, binder material. The binder, typically a natural or synthetic polymeric material, aids in adhering the dark charge exchange material to the electrode surface and also aids in obtaining a resultant layer which is smooth, uniform, and continuous. Useful binder materials typically have been found to be electrically insulating materials having a resistivity of greater than about $10^9$ ohm-cm, preferably greater than about $10^{12}$ ohm-cm., at 25°C. When a binder is used, the particular binder material selected should, of course, be substantially insoluble in any liquid contained in the liquid imaging suspension, if such a liquid is used.

Among the various binder materials which may be useful as polycarbonates, such as a bisphenol A polycarbonate, e.g., Lexan 145 (a trademark of the General Electric Co. for a polycarbonate polymer); poly(vinyl acetals) such as poly(vinyl butyral), e.g., Butvar B-76 (a trademark of Shawinigan Products Corp.); polyesters, e.g., Vitel PE 101 (a trademark of Goodyear Tire and Rubber Co. for poly[ethylene-co-alkylenebis(alkylene-oxyaryl)phenylene-dicarboxylate]); etc.

When a binder is used in the dark charge exchange layer, the amount of binder used may vary over a considerable range. The optimum amount of binder depends, in part, on the efficiency of the dark charge exchange material relative to a particular kind of electrically photosensitive particle, i.e., the ability of the material to exchange charge with the unexposed photosensitive particles, and the compatibility of a given binder with a given dark charge exchange material, e.g., certain binders because of their particular composite physical, chemical, and electrical properties may enhance or detract from the dark charge exchange capability of a given dark charge exchange material. Thus, for very efficient dark charge exchange materials, larger amounts of binder, if one is employed, may be used in comparison to the amount of binder used with less efficient dark charge materials. Of course, the amount of binder should not be so large in comparison to the amount of the dark charge exchange material, that the resultant dark charge exchange properties of the final layer become so diluted or weak as to be nonexistant. (See Examples 16 and 17 hereinafter.)

For dark charge exchange materials having an efficiency comparable to, for example, 2,4,7-trinitro-9-fluorenone, the amount of binder is typically within the range of about 22 weight percent to about 50 weight percent, preferably about 25 to about 40 weight percent, based on the dry weight of the dark charge exchange layer. The amount of dark charge exchange material used when a binder is employed is typically within the range of about 99 to about 10 weight percent, preferably 75 to about 20 weight percent, based on the dry weight of the dark charge exchange layer. Of course, when no binder is used, the dark charge exchange layer may consist entirely of the dark charge exchange material.

The dark charge exchange layers may be applied by various methods. For example, the dark charge exchange layers may be applied by vacuum evaporation. To obtain a uniform coating of dark charge exchange material and binder wherein the dark charge exchange material is distributed homogeneously throughout the layer, it has been found particularly useful to employ a solvent coating technique wherein the binder and dark charge exchange material are dissolved in a common solvent(s) and then coated as a solution onto the desired electrode surface. As a result, one obtains, after evaporation of the liquid solvent coating vehicle, a uniform layer composed of a solid solution of the binder and dark charge exchange material. Dark charge exchange layers having varying thicknesses may be employed. Dark charge exchange layers applied by vacuum evaporation such as indium or essentially pure 2,4,6-trinitro-9 -fluorenone, typically have a thickness on the order of about 50 angstroms to about 200 angstroms. Dark charge exchange layers comprising a binder have been found effective at dry thicknesses of from about 5 microns to about 50 microns. Thinner or thicker dark charge exchange layers may also be used. As suggested above, however, the layers of dark charge exchange material must contain a sufficient amount of dark charge exchange material to permit uniform, ie., substantially complete, coverage of the exposure zone surface with an effective amount of the dark charge exchange material. For example, it is possible to apply such a thin layer of a dark charge exchange material, such as 2,4,7-trinitro-9-fluorenone, that there may be an insufficient amount of dark charge exchange material deposited to cause PIER operation, and the photosensitive particles may tend to revert to a PEP mode of operation. (That is, the exposed particles, rather than the unexposed particles, may begin to exchange charge and reverse their polarity upon contact with such extremely thin layers of dark charge exchange material. See Example 16 set forth hereinafter.)

Although certain of the dark charge exchange layers described herein are known to possess at least some degree of photoconductivity in at least certain areas of the electromagnetic spectrum, it has been determined that the dark charge exchange properties of these layers are not equivalent to any photoconductive properties these layers may possess, and it is believed that the dark charge exchange properties of these layers are substantially independent of any photoconductivity these layers may exhibit. In this regard, reference may be made to Example 9 set forth hereinafter which demonstrates an operative PIER process wherein a dark charge exchange layer composed of (a) 2,4,7-trinitro-9-fluorenone and (b) a poly(vinyl butyral) binder is subjected to a white tungsten light exposure which has been filtered to remove virtually all of the small amount of the ultraviolet component generated by such a light source. (Compositions composed of a binder and 2,4,7-trinitro-9-fluorenone are generally regarded as nonphotoconductive in the presence of visible light but do exhibit some degree of photoconductivity in the presence of ultraviolet light.)

The electrically photosensitive particles used in PIER may be selected from a variety of photoconductive materials. Extensive discussion and description of such materials appear in the literature, for example, in the Sugarman, Uhrig, Kaprelian, and Tulagin et. al. patents referenced above. For this reason, extensive discussion regarding these materials is considered unnecessary in the present specification.

It may be noted that the physical composition of these electrically photosensitive particles may vary widely. For example, single component particles which are both photosensitive to activating radiation of the desired wavelength and have the desired color may be used as described in Sugarman, U.S. Pat. No. 2,758,939. Examples of such particles are various inorganic pigments such as an oxide, sulfide, selenide, telluride, or iodide of cadmium, zinc, mercury, antimony, bismuth, thallium, indium, molybdenum, aluminum and lead. Other photoconductive inorganic materials include arsenic trisulfide, cadmium arsenide, lead chromate, selenium, sulfur, etc. Various organic photoconductive pigments such as phthalocyanine pigments, azo pigments, quinacridone pigments, anthraquinone pigments, and the like may also be used. The above-noted substances are well known photoconductive materials.

In addition, multi-component electrically photosensitive particles such as those described in Sugarman, U.S. Pat. No. 2,758,939 and Kaprelian U.S. Pat. No. 3,143,508 issued Aug. 4, 1964 may be used. In such case, the particles may comprise a separate photoconductive component and a separate colorant component such as a dye or pigment and, optionally, a binder such as a polymeric material, a filler material, for example, glass or plastic beads, chemical and spectral sensitizers such as various sensitizing dyestuffs, etc. In addition, one or more filter layers may be present in these multicomponent particles.

The electrically photosensitive particles used in the present invention may be all of one color to form a monochrome image.

Figure 4A:
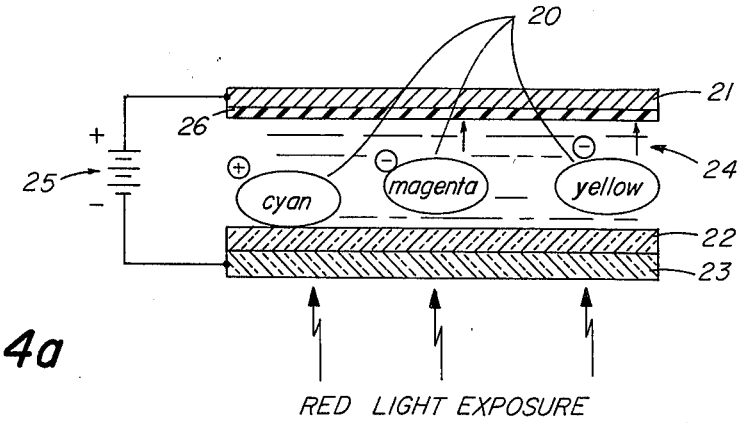
FIG. 4*a*–4*c* illustrates a typical color image-forming PIER process.
Figure 4B:
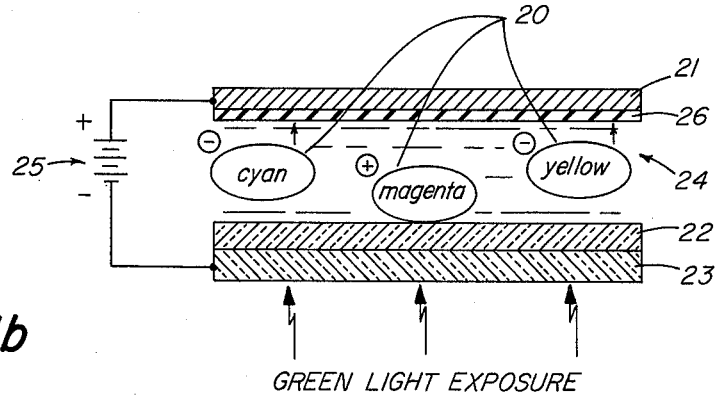
Figure 4C:
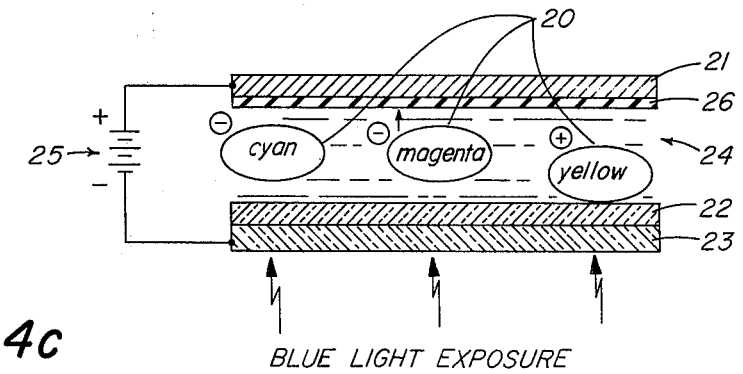

Alternatively, in accord with certain especially preferred embodiments of the invention, an admixture of differently colored particles may be used. For example, as illustrated in FIG. 4*a*–4*c* a mixture of cyan, magenta, and yellow particles which are electrically photosensitive to red, green, and blue light, respectively, may be used to form, through subtractive color formation, multi-color images corresponding to the color of the original exposure. In FIG. 4*a*–4*c*, a multicolor mixture of cyan, magenta, and yellow particles 20 which are electrically photosensitive to red, green, and blue light, respectively, are dispersed in an electrically insulating liquid 24 between electrodes 21 and 23. Electrode 23 is transparent and has coated on the surface thereof a transparent dark charge exchange layer 22. Electrode 21 preferably has coated on the surface thereof blocking layer 26, although useful multicolor images can also be obtained in PIER by employing electrode 21 free from blocking layer 26. Particles 20 initially carry a positive polarity electrostatic charge. As illustrated in FIG. 4*a*, an electric field is applied using potential source 25 between electrodes 21 and 23, and simultaneously therewith particles 20 are exposed to red light. As a result positively charged particles 20 migrate to dark charge exchange layer 22 where the cyan colored particles which are sensitive to red light are immobilized. The magenta and yellow colored particles which are not sensitive to red light exchange charge with layer 22 thereby reversing polarity to become negatively charged and are repelled from layer 22 to positive polarity electrode 21. Thus, as shown in FIG. 4*a*, a cyan colored negative appearing image of the original red light exposure is formed on the surface of layer 22 and a positive appearing red colored image (formed by the subtractive color combination of magenta and yellow particles) of the original red light exposure is formed on blocking layer 26. In a similar manner, as shown in FIG. 4*b* and 4*c*, green and blue light exposures of particles 20 will result in the formation of green and blue positive appearing images, respectively, on layer 26 and magenta and yellow negative appearing images, respectively, on dark charge exchange layer 22. In accord with the various multicolor embodiments of PIER, random mixtures of two, three, or more differently colored electrically photosensitive particles are employed. Each differently colored particle is responsive to a specific given wavelength of activating radiation so that multiple color images are produced by a single exposure of the electrically photosensitive particle mixture to light composed of a mixture of the various specific wavelength radiation to which each of the differently colored particles are sensitive.

The intensity of the exposure to activating radiation used in PIER may vary depending on the particular electrically photosensitive particles selected, the relative transparency of the electrode and dark charge exchange layer or blocking layer through which exposure may be effected, and the like. The intensity of the exposure should be sufficient to prevent the exposed particles from undergoing a net change in charge polarity upon electrical contact with the dark charge exchange layer. For example, when a liquid imaging suspension employing finely-divided copper phthalocyanine pigment particles dispersed therein is exposed to visible light through a dark charge exchange layer containing 2,4,7-trinitro-9-fluorenone coated on a NESA glass electrode, a tungsten light source of sufficient wattage to provide an exposure intensity greater than about 50 footcandles on the liquid imaging suspension has been found to provide readily discernible visible images.

The size of the electrically photosensitive particles used in PIER may vary considerably, depending upon the image resolution desired, whether the particles are used in a liquid suspension or simply disposed as a dry powder in the gap between the two electrodes described herein. Typically, the size of the particles varies between about 0.1 micron and 100 microns, although larger or smaller particles may be employed under certain conditions. Generally, where liquid particle suspensions are used, the particles have an average particle size less than about 3 microns, generally from about 0.1 to about 1 microns. Where a dry powder is used, the particles typically are larger, generally having an average particle size of from about 2 to about 20 microns. Where high resolution, continuous tone images are desired, it is generally preferable to use a liquid imaging particle suspension.

In a preferred embodiment of the present invention, the electrically photosensitive particles used in the invention are suspended in an electrically insulating carrier liquid between the two spaced electrodes. For this reason, the process of the present invention is referred to herein as "electrophoretic" which, of course, connotes movement or migration of charge-bearing particles in a fluid, generally a liquid. It should be understood, however, that it is believed that the PIER process of the invention may also be used in non-liquid fluid media such as air or other gas or even in a vacuum wherein electrically photosensitive particles having a positive polarity electrostatic charge are simply randomly deposited as a dry powder in the gap between the two spaced electrodes.

Among the various reasons for generally preferring the use of an electrically insulating carrier liquid is the fact that, at the present time, much better image resolution can be obtained by dispersing the electrically photosensitive particles as extremely finely-divided particles in a liquid carrier medium. In addition, it is possible to operate at higher field strengths between the spaced electrodes when using a liquid carrier, rather than conventional gaseous fluid carriers such as air. This is because air, for example, will break down and ionize at relatively low operating voltages as compared to many readily available electrically insulating liquid materials.

Typically, when a liquid carrier is used, a material having a resistivity greater than about $10^9$ ohm-cm., preferably greater than about $10^{10}$ ohm-cm., and, preferably, a low dielectric constant less than about 3.0 is advantageously employed. Among the various useful liquid carrier vehicles are alkyl-aryl materials such as the alkylated benzenes, e.g., xylenes, and other alkylated aromatic hydrocarbons such as are described in U.S. Pat. No. 2,899,335. Other useful liquid carrier vehicles are various hydrocarbons and halogenated hydrocarbons such as cyclohexane, cyclopentane, n-pentane, n-hexane, carbon tetrachloride, fluorinated lower alkanes such as trichloromonofluoromethane, trichlorotrifluoroethane, etc. typically having a boiling range of from about 2°C to about 55°C. Particularly useful hydrocarbon liquid carrier vehicles are the paraffinic hydrocarbons, for example, the isoparaffinic hydrocarbon liquids having a boiling point in the range of 145°C to 185°C (sold under the trademark Isopar by Exxon Corporation). Various other petroleum distillates and mixtures thereof may also be used as liquid carrier vehicles. Additional useful insulating liquids include Sohio Odorless Solvent (a kerosene fraction available from Standard Oil Co. of Ohio). Molten liquid insulating thermoplastic materials could also be used.

When a liquid imaging suspension is used, the concentration of the electrically photosensitive particles in the liquid should be considered. In contrast to known PEP liquid imaging suspensions as described in the Tulagin et. al. patents referenced earlier herein which are characterized by Tulagin et. al. as preferably containing from 5 to 6 weight percent of electrically photosensitive particles, it is generally preferred to use from about 0.01 to less than about 3.5 weight percent of electrically photosensitive particles in PIER. In some cases, it has been observed in PIER that as the particle concentration approaches about 5 to 6 weight percent or greater, the image quality provided by PIER tends to degrade, particularly the quality of the images formed on the blocking layer electrode.

It will be appreciated, of course, that as more efficient dark charge exchange materials and electrically photosensitive particles are investigated and developed, the concentration of the particles in the liquid imaging suspension used in PIER may be increased. However, it is significant to point out that useful multicolor images have been achieved in PIER using the relatively low particle concentrations noted above, i.e., less than about 3.5 weight percent. To date, best multicolor imaging results have generally been obtained using multicolor imaging suspensions containing from about 0.1 to about 1.5 weight percent of electrically photosensitive particles.

As indicated previously, when a liquid imaging suspension is used, it is frequently desirable to incorporate a charge control agent in the suspension. Such materials are well known in the field of liquid electrographic developer compositions where they are employed for purposes susbtantially similar to that described herein. Thus, extensive discussion of these materials herein is deemed unnecessary. These materials typically are polymeric materials incorporated by admixing the polymer in the liquid carrier vehicle of the suspension. The charge control agents appear to function as dispersion and electrostatic charge stabilizers for the suspension. For example, it has been found that upon addition of a styrene-vinyl toluene copolymer such as Piccotex 100 to an imaging suspension containing photosensitive materials which normally provide both positive polarity and negative polarity particles in the suspension, a reduction in negative polarity particles is achieved so that one obtains a greater uniformity in the charge polarity exhibited by the suspended particles. In addition to and possibly related to the aforementioned enhancement of uniform charge polarity, it has been found that the charge control agents often provide more stable suspensions, ie. suspensions which exhibit substantially less settling out of the dispersed photosensitive particles.

Typical polymeric materials which may be used as charge control agents in the above-described liquid imaging suspensions are electrically insulating (ie. have an electrical resistivity at 25°C of greater than about $10^9$ ohm-cm.) natural and synthetic polymeric materials, waxes, and the like, for example Piccotex 100 a tradename of Pennsylvania Industrial Chemical Corp. for a styrene-vinyl toluene copolymer, which are wholly or at least partially soluble in the liquid carrier vehicle of the imaging suspension. As will be apparent to those of ordinary skill in the art, the selection of a particular charge agent will depend, in large part, on the particular electrically photosensitive particles and liquid carrier vehicle The strength of the electric field applied between the spaced electrodes used in PIER may vary considerably depending upon a number of factors such as the impedence of the specific dark charge exchange layer and blocking layer (if one is used), the desired image density, the dielectric strength of the fluid medium (for example, as is well-known many electrically insulating liquids can withstand higher field strengths than gaseous media such as air), the degree of image resolution desired, the particular charge control agent and electrically photosensitive particles employed, etc. Generally, as in PEP processes such as described by Sugarman in U.S. Pat. No. 2,758,939, it has been found in PIER that optimum image density and resolution are obtained by increasing the field strength to as high a level as possible without causing breakdown of the fluid medium in the interelectrode gap. For example, when electrically insulating liquids, such as an isoparaffinic hydrocarbon, e.g., Isopar G, are used, field strengths greater than about 10,000 volts/mm. have been found to give discernible images, although higher fields ranging from about 20,000 volts/mm. – 160,000 volts/mm. are preferred, especially to improve image resolution and to achieve improved color separation when multicolor images are formed. In general, for a given set of imaging conditions, there is no critical field strength below which an image suddenly disappears and above which an image suddenly reappears. Rather, it is observed that as the field strength is decreased, image quality gradually declines. Comparing PIER to PEP, it has been observed that readily discernible images may be formed (using a liquid imaging suspension) in PEP with field strengths as low as 4000–4800 volts/mm (i.e., 100–120 volts/mil).

Figure 5:
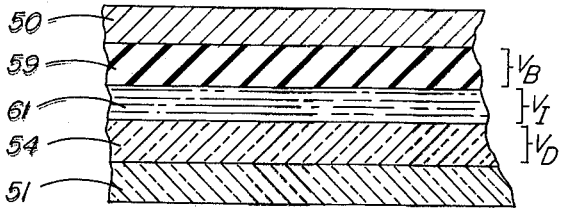
FIG. 5 represents diagrammatically the individual components of the toral voltage difference between the spaced electrodes used in PIER.

As used herein, the field strength is defined as the voltage drop across the interelectrode gap, excluding voltage drops occurring across the dark charge exchange layer and the blocking layer coated on the surfaces of the spaced electrodes. FIG. 5 represents diagrammatically the total voltage drop, $V_T$, occurring in PIER using a liquid imaging suspension 61 disposed between a pair of spaced electrodes 50 and 51. As indicated, the interelectrode voltage drop $V_I$, occurring across the gap occupied by liquid imaging suspension is actually only one of three components contributing to the total voltage drop between electrodes 50 and 51. There is also a voltage drop, $V_B$, occurring across blocking layer 59 (if one is used) and a voltage drop, $V_D$, occurring across dark charge exchange layer 54. The total voltage drop, $V_T$, is equal to the sum of $V_D$, $V_I$, and $V_B$. In practice, $V_T$ is the actual voltage measured. $V_I$ may be computed by experimentally determining the voltage drop occurring across the blocking layer and dark charge exchange surface and then subtracting these values from the measured $V_T$. Alternatively, in some instances one can approximate $V_I$ by using a liquid imaging suspension having a thickness known to be much greater than the thickness of either blocking layer 59 or dark charge exchange layer 54, and then assuming that the sum of $V_B$ and $V_D$ is relatively small compared to $V_I$ so that to a first approximation $V_T \approx V_I$. It will be appreciated, however, that where (as often is the case in actual practice) the electrode surfaces are closely spaced to one another such that the interelectrode gap becomes equal to or less than the thickness of the dark charge exchange layer and/or the blocking layer, the voltage drops which occur across these layers becomes an increasingly larger portion of the total voltage drop between the spaced electrodes and cannot be ignored.

The electrode spacing used in PIER may vary depending on whether a liquid imaging suspension or a gaseous fluid or vacuum is used and on whether an electrically insulating binder is used in the dark charge exchange layer. For example, in the case where liquid imaging suspensions are employed, it is preferred to use quite small electrode spacings on the order of about 50 microns or less, which amounts to virtual contact of the electrodes except for a very thin film of the liquid imaging suspension which is sandwiched between the electrodes. In the case where an air gap is used, larger interelectrode spacings may have to be employed due, in part, to the larger photosensitive particle size employed when a vacuum or gaseous fluid is used.

The electrodes used in PIER may be composed of a variety of different conducting materials and may have a variety of different shapes. For example, the electrodes may be composed of substantially inflexible materials such as various metallic plates or metal-coated supports, e.g., NESA glass, or flexible materials such as film supports coated with thin conducting films, e.g., evaporated metal films and the like. The electrically conducting material forming the electrodes may be selected from such diverse materials as conducting inorganic materials such as cermets and various conducting metals, e.g., nickel, aluminum, tin oxide, etc., conducting organo-metallic materials; and conducting organic materials such as various conducting polymers. Typically, the conducting materials useful as the electrodes used in PIER have a specific resistivity less than about $10^8$ ohm-cm. at 25°C.

Figure 6:
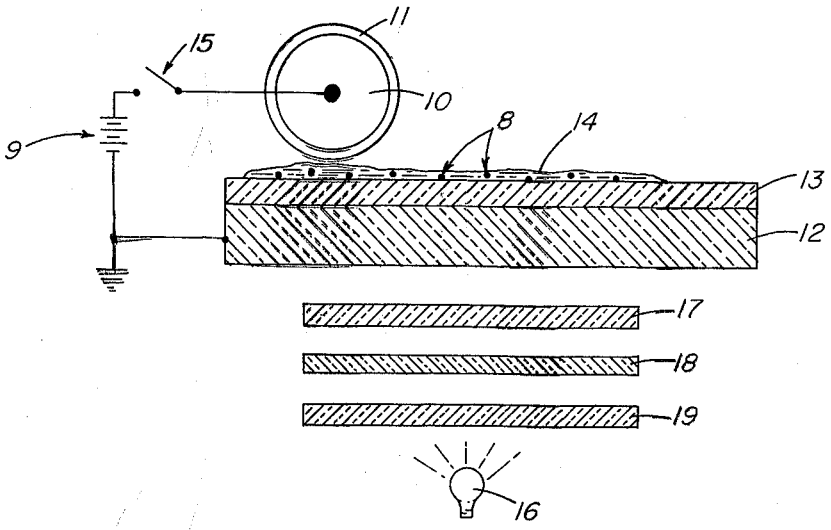
FIG. 6 illustrates typical imagining apparatus for use in a PIER process wherein exposure is effected through an electrode at least partially transparent to the activating radiation.

The shape of the electrodes used in PIER may vary including the use of a substantially flat plate bearing a conductive surface, a web or belt support bearing a conducting surface, a roller or drum bearing a conductive surface, etc. In this regard, the spaced electrodes used in PIER may both be of the same general shape and material composition or may be of differing shapes and material composition. For example, one may use two conducting drum electrodes, each bearing an appropriate blocking or dark charge exchange surface, with the electrically photosensitive particles disposed in the nip between the two drum electrodes. Alternatively, one of the electrodes may be a drum or flexible web electrode and the other electrode may be a substantially flat plate. In addition, one or both electrodes may move relative to one another (as illustrated in FIG. 6); or both electrodes may be fixed as described in the aforementioned Sugarman, Uhrig, and Kaprelian patents. Accordingly, within the general operational parameters of the present invention, it will be apparent, that the specific electrode shape, composition, and whether it moves or is fixed, is not critical. Of course, any one of these factors may become highly significant depending upon the particular application in which the general PIER process is employed, ie., a camera, a document copier, an optical display device, etc. It may be further noted that various non-interfering adhesive subbing layers may be used, if desired, to promote adhesion between a particular electrode and a particular blocking layer and/or dark charge exchange layer.

Figure 7:
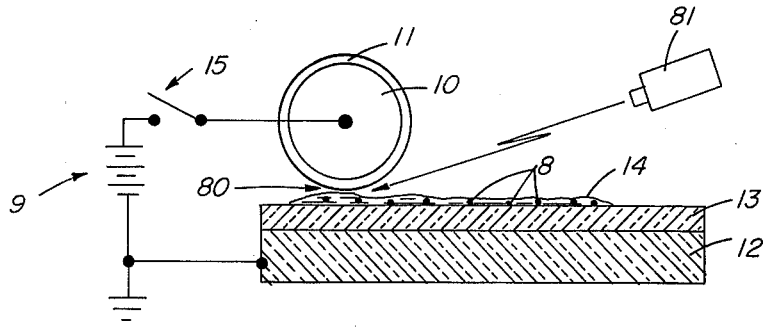
FIG. 7 illustrates an alternative imaging apparatus for use in PIER wherein exposure to activating radiation is effected without exposing through an electrode.

Preferably, at least one of the electrodes used in PIER is at least partially transparent to the particular activating radiation employed to facilitate exposure of the photosensitive particles. If the electrode bearing the dark charge exchange layer is the electrode through which exposure is effected, then the dark charge exchange layer should also be at least partially transparent. In certain situations, for example, if one desired to employ the present invention in an optical display device, it may be useful to employ two transparent electrodes. In such case, exposure could be made through one transparent electrode and read-out could be effected through the other transparent electrode. Of course, because exposure through the electrodes used in PIER is not required, one does not have to use transparent electrodes. In this regard, reference is made to FIG. 7 which illustrates an apparatus for practicing PIER which does not require the use of a transparent electrode. (In FIGS. 6 and 7 like numbers refer to like apparatus and materials.) In FIG. 7, liquid imaging suspension 14 is exposed by projection exposure means 81 in the nip 80 formed between conductive roller electrode 10 and electrode 12. Electrode 12 bears on the surface thereof dark charge exchange layer 13 and electrode 10 bears on the surface thereof blocking layer 11. A potential difference between electrodes 10 and 12 is created as illustrated by circuit 9 in FIG. 7 such that electrode 12 is the negative polarity electrode and electrode 10 is the positive polarity electrode.

As discussed above, one of the electrodes used in PIER advantageously bears a blocking layer on its surface. Although the use of a blocking layer represents a preferred embodiment of the PIER process, such a blocking layer is not required by the process as illustrated in appended Example 27. This blocking layer may be permanently adhered to the electrode to which it is applied or merely temporarily affixed thereto as explained hereinafter with reference to FIG. 6. As used herein, the term "blocking layer" or "blocking electrode" refers to a material which, when formed on a conductive electrode surface, minimizes charge exchange with the electrically photosensitive particles in electrical contact therewith under normal imaging conditions so that no serious PIER image degradation occurs. The blocking layer (as described in Sugarman, U.S. Pat. No. 2,758,939) is generally composed of various electrically insulating materials including various papers, dielectric coated papers, natural or synthetic polymer films, waxes, and the like. Typical blocking materials which have been found useful are film-forming materials which have an electrical resistivity greater than about $10^9$ ohm-cm., preferably greater than about $10^{12}$ ohm-cm, at 25°C, for example, poly(ethylene terephthalate), poly(vinyl butyral), and the like. Useful such blocking layers typically have a dry thickness within the range of 5 to about 200 microns, although thicker and somewhat thinner layers may also be used. It should be recognized, that if the blocking layer is too thin, the blocking layer may become ineffective. Of course, it will be appreciated that the useful thickness of a particular blocking layer will depend, in large part, on the specific material selected.

One electrode configuration which has been found useful in PIER is illustrated in FIG. 6 and is used in each of Examples 1–26 appended hereto. In the electrode configuration of FIG. 6, there is employed electrode means 10 and 12 operably associated with one another such that, during imaging, blocking layer 11 of electrode means 10 is essentially in line contact with liquid imaging suspension 14 and is moving relative to electrode means 12 at a rate effective to permit photosensitive particles 8 which are not exposed to light to reverse their charge polarity upon electrical contact with dark charge exchange layer 13 while photosensitive particles 8 which are exposed to light are immobilized at layer 13 upon making electrical contact therewith. The electrode configuration of FIG. 6 comprises a conductive metal roller 10 bearing a blocking layer 11, such as a dielectric coated paper, spaced apart from a transparent conductive plate 12, such as NESA glass, bearing a dark charge exchange layer 13. A liquid imaging suspension 14 containing a multiplicity of positively charged electrically photosensitive particles 8 may be applied to the surface of dark charge exchange layer 13. Exposure from light source 16 is transmitted through plate 12. The original image 17 to be projected onto plate 12, such as a photographic transparency or the like, is typically positioned together with any necessary or desired color separation filters 18 and other light filters 19, such as ultra-violet filters, between source 16 and plate 12. In such a configuration, as roller 10 is rolled over layer 13 bearing imaging suspension 14 a potential difference may be applied across plate 12 and roller 10 (which are connected to electrical source 9) by closing switch 15, and substantially simultaneously exposure of suspension 14 to a pattern of activating radiation may be effected. As a result an image composed of unexposed photosensitive particles is formed on blocking layer 11 and a complementary image of exposed particles is formed on dark charge exchange layer 13. Either image or both may be used. In the electrode configuration of FIG. 6, roller speeds may vary. Roller speeds within the range of about 25 cm/sec. or less, preferably about 0.5 to about 10 cm./sec., have been found satisfactory. It has been observed that when the electrode configuration of FIG. 6 is used, roller speeds, greater than, e.g., 15 cm./sec., can result in degradation of PIER image quality. This is believed to be due, at least in part, to the electrical photosensitivity of the photosensitive particles which are presently being used in PIER. As materials exhibiting greater electrical photosensitivity are found, it is believed that faster roller speeds will be possible. For example, it has been found possible to avoid a certain amount of the image degradation which can occur at more rapid roller rates by using higher intensity exposures and higher electrical field strengths.

As indcated, using the electrode configuration of FIG. 6, two complementary images typically are formed. The image formed on receiver sheet 11 is a positive appearing image of the original image 17 and the image formed on dark charge exchange layer 13 is a negative-appearing image. If it is desired, as often may be the case, to reuse the apparatus of FIG. 6 to form additional images, either one or both of the images on receiver sheet 11 and dark charge exchange layer 13 may be transferred to other receiver elements. Various well-known electrographic image transfer techniques, such as electrostatic transfer, adhesive transfer using an adhesive tape material to pick off the image, and the like may be employed.

Alternatively, the images formed on blocking layer 11 and dark charge exchange layer 13 may be permanently fixed or adhered to these layers. This may be accomplished by various conventional means such as by overcoating the image with a thin protective polymer film. For example, a separate polymer overcoat can be applied subsequent to image formation, or if a suitable polymeric binder is contained in the liquid imaging suspension, it may be used as a fixing agent.

Although it will be appreciated that actual imaging apparatus constructed as illustrated in FIG. 6 may vary in many respects, the following reference information is provided relative to the specific apparatus used in Examples 1–26. The outside diameter of the conductive metal roller 10 is approximately 4.1 cm. The roller 10 is composed of aluminum. All exposure readings described in Examples 1–26 are measured in footcandles at the surface of imaging suspension 14. These exposure readings, however, are the exposure readings measured for the "unfiltered" light source used in each example; that is, these readings are not corrected for the filter factors of filters 18 and 19 (used in some of the following examples) or any filtration effect caused, for example, by the light passing through the original image pattern 17. The readings presented in the following examples do, of course, take into account the filtration effect caused by plate 12, layer 13, and suspension 14. The spacing between dark charge exchange layer 13 and blocking layer 11 in Examples 1–12B and 13–26 is quite small, consisting solely of the thickness of a thin film of liquid imaging suspension 14. In effect, in the aforementioned Examples, except for the very thin film of liquid imaging suspension 14, layers 13 and 11 are in virtual contact with one another. In Example 12C, 50 micron thick spacers, not shown in FIG. 6, are inserted between blocking layer 11 on roller electrode 10 and dark charge exchange layer 13 during imaging.

The invention can be further illustrated by the following examples.

Example 1: Two Color Images with Indium Dark Charge Exchange Surface

Indium metal was vacuum evaporated at about 0.4 optical density onto the surface of a conductive glass plate composed of NESA glass to form a transparent dark charge exchange layer 13 in an imaging apparatus of the type illustrated in FIG. 6. A dielectric paper covered conductive roller electrode was used to receive unexposed migrated photoconductive pigment particles. The conductive roller electrode 10 was composed of aluminum and the dielectric paper 11 was a paper support coated with an insulating layer of poly(vinyl butyral) resin having a dry thickness of about 10 microns purchased under the tradename Butvar B-76 from Shawinigan Products Corp.

Two separate photoconductive pigment dispersions (A) and (B) were prepared for use in this Example by ball milling the formulations given below for approximately two weeks in 60 ml. brown glass bottles filled to one-half volume with 0.32 cm. diameter stainless steel balls.

Pigment Dispersion A:

0.1 gm of cyan particles composed of the beta form of copper phthalocyanine C.I. No. 74160, available from American Cyanamid under the tradename of Cyan Blue GTNF 35 gm of a mixture of a styrene-vinyl toluene copolymer (available under the tradename of Piccotex 100 from Pennsylvania Industrial Chemical Corp.) and an isoparaffinic aliphatic hydrocarbon liquid sold under the trademark Isopar G by Exxon Corp. of New Jersey. This 35 gm admixture consists of equal parts by weight of Piccotex 100 and Isopar G.

Pigment Dispersion B:

Same as pigment dispersion A except that magenta particles composed of Watchung Red B, a barium salt of 1-(4'-methyl-5'-chloroazobenzene-2'-sulfonic acid)-2-hydroxy-3-naphthoic acid, C.I. No. 15865, sold by E. I. DuPont de Nemours and Co. was used to replace the Cyan Blue GTNF pigment.

Prior to imaging, equal volumes of dispersions A and B were combined and a small amount of this blended cyan and magenta pigment dispersion was spread onto the indium surface as the liquid imaging suspension 14. An electrical potential of + 1.0 Kv was applied to the paper covered roller electrode while it was rolled at a forward rate of about 3–5 cm/sec. across the indium dark charge exchange surface bearing suspension 14. Simultaneous with the movement of the roller electrode, a tungsten lamp exposure was made. The exposure using the tungsten source first passed through Kodak Wratten Filter No. 47B (blue), Kodak Wratten Filter No. 58 (green), and Kodak Wratten Filter No. 29 (red) color separation filters, each filter located in a different exposure area, then through image 17 composed of a black-and-white photographic negative and finally through the indium/NESA glass transparent electrode carrying the imaging suspension.

Observations:

On the indium dark charge exchange layer a discernible, low density cyan image was observed in the red light exposed areas and a magenta image was observed in the green light exposed areas. A two color pigment image was formed on the dielectric paper receiver 11 in areas corresponding to areas of the pigment dispersions not exposed to light thus illustrating that the exposed particles did not transfer or migrate from the indium surface to the dielectric paper covered roller electrode.

Example 2: Two Color Images with Modified Dark Charge Exchange Surface

In this example the imaging apparatus and materials were identical to Example 1 except the dark charge exchange surface of this example was formed by coating from dichloromethane an overcoat layer of the following composition on the surface of the NESA glass plate.

0.5 g. indium particles
0.2 g. 2,4,7-trinitro-9-fluorenone
0.2 g. Lexan 145 Bisphenol-A polycarbonate sold by General Electric Co.
20 ml. dichloromethane The overcoat layer was dried to remove substantially all of the dichloromethane coating vehicle. The resultant layer was about 25 $\mu$ thick. The pigment dispersions for imaging were identical to Dispersions A and B described in Example 1 with the exception that they were milled for approximately 10 days and then rested (stored) for 1 week. The separate dispersions were mixed as in Example 1 just prior to use.

The blended pigment dispersion was applied to the overcoated NESA glass plate to form the liquid imaging suspension. Conductive roller electrode 10 bearing a dielectric coated paper as in Example 1 was rolled over the coated NESA plate bearing the liquid imaging suspension using an electrode bias of + 1.5 Kv with simultaneous white light exposure from a tungsten lamp through image 17 composed of a black-and-white photographic negative transparency. (No color filters were used in the exposure of this example.)

Observations:

The image formed on the dark charge exchange surface coated on the NESA plate indicated that particles in exposed areas did not migrate to the roller. The image on the dark charge exchange layer coated on the NESA plate exhibited low background and red and green separation. This image was subsequently transferred to a suitable dielectric paper receiver sheet by applying a −1.0 Kv potential to a conductive roller serving as a temporary conductive backing for the paper receiver.

The image initially formed on the dielectric paper covering roller 10 was the same sense as the original image, that is, a positive image, indicating that unexposed particles migrated to the roller. This image had some background density and good image quality.

Example 3: Three Color Images with Modified Dark Charge Exchange Surface

Cyan and magenta pigment dispersions as prepared in Example 2 were used in this example. In addition, a yellow photoconductive pigment dispersion (D) was prepared from the following formulation:

Dispersion D:

0.2 gm. of yellow particles composed of a flavanthrone pigment, C.I. No. 70600, purchased under the tradename of Indofast Yellow from Harmon Colors Co.
35 gm of a mixture of Piccotex 100 resin and Isopar G
This 35 gm admixture consisted of equal parts by weight of Piccotex 100 and Isopar G.

Dispersion D was ball milled for four weeks, rested for one week and combined in equal volumes just prior to use with the cyan and magenta dispersions to form a blended pigment dispersion as the liquid imaging suspension.

The dark charge exchange surface and imaging apparatus were identical to those of Example 2.

The PIER process was carried out by biasing the dielectric paper covered aluminum roller at an electrical bias +1.5 Kv using the same procedure described in Example 2. The aluminum roller velocity was about 3 to 5 cm/sec.

Observations:

The image formed on the dark charge exchange surface had well-separated magenta, yellow and cyan pigments in those areas exposed by green, blue and red light, respectively.

The image formed on the dielectric paper covered aluminum roller electrode showed that pigment particles migrated to the roller in the unexposed areas of the dark charge exchange surface.

Example 4: Cyan Image with 2,4,7-trinitro-9-fluorenone Dark Charge Exchange Surface A photoconductive cyan pigment dispersion (E) of the following composition was prepared:

Dispersion E:

0.2 gm. Cyan Blue GTNF
35 gm of a mixture of Piccotex 100 and Isopar G
This 35 gm admixture consisted of equal parts by weight of Piccotex 100 and Isopar G.

The above pigment dispersion was ball milled for two weeks in a small brown glass bottle containing 0.32 cm. diameter stainless steel balls filled to the level of the dispersion.

In this example, the dark charge exchange surface 13 coated on the NESA glass plate electrode 12 of FIG. 6 was a saturated solid solution of 2,4,7-trinitro-9-fluorenone in a Lexan 145 polycarbonate binder. The layer was coated from a 50% solution of the binder in dichloromethane solvent and then dried to form a transparent layer approximately 25 microns thick of polycarbonate and 2,4,7-trinitro-9-fluorenone. The layer consisted of equal parts by weight polycarbonate and 2,4,7-trinitro-9-fluorenone.

Pigment dispersion E was used as liquid imaging suspension 14 and was spread across surface 13 by a dielectric coated paper identical to that used in Example 1 mounted on roller electrode 10. Roller electrode 10 was held at an electrical bias of +1.5 Kv relative to plate 12 and moved across plate 12 at a roller velocity of about 3–5 cm/sec. The pigment dispersion E was simultaneously subjected to a tungsten light exposure through plate 12. The light exposure originated from a tungsten light source and first passed through a red Wratten 29 filter and then an image 17 composed of a black-and-white photographic negative transparency before passing through plate 12.

Observations:

The image formed on the dark charge exchange surface indicated that the red-light exposed particles remained on the dark charge exchange surface. The image formed on blocking layer 11 mounted on the roller electrode indicated that pigment particles migrated in the unexposed areas to form a red image on layer 11 having the same image sense as the original black-and-white negative image.

Example 5: Magenta Image with 2,4,7-trinitro-9-fluorenone Dark Charge Exchange Surface A magenta pigment dispersion (F) was prepared according to the following formulation:

Dispersion F:

0.2 gm. Watchung Red B 35 gm. of a mixture of Piccotex 100 and Isopar G. This admixture consisted of equal parts by weight of Piccotex 100 and Isopar G.

Pigment dispersion F was used as liquid imaging suspension 14. The dark charge exchange surface 13 and the method of imaging were similar to that of Example 4 except that a green Kodak Wratten Filter No. 58 filter was used in place of the red Kodak Wratten Filter No. 29 filter used in Example 4.

Observations:

The image formed on the dark charge exchange surface indicated that the green light exposed particles remained on the dark charge exchange surface. The image formed on layer 11 of the roller electrode 10 indicated that pigment particles migrated in unexposed areas of the dark charge exchange surface to form a magenta image on layer 11 having the same image sense as the original image.

Example 6: Three Color Imaging with Sohio Odorless Solvent 3440 and 2,4,7-trinitro-9-fluorenone/poly(vinyl butyral) Dark Charge Exchange Surface Separate magenta, yellow and cyan photoconductive pigment dispersions were formed. Each dispersion contained 2.0 gm. of pigment, either Watchung Red B, or Indofast Yellow or Monolite Fast Blue GS (C.I. No. 74100, the alpha form of metal free phthalocyanine available from the Arnold Hoffman Co.) and was prepared by ball milling (using stainless steel balls) each of these pigments in separate bottles for 7 days in 12 gm. of Sohio Odorless Solvent 3440 (available from Standard Oil Co. of Ohio). These three pigment dispersions were blended together in equal volumes and then diluted with additional Sohio Odorless Solvent 3440 (20 parts volume of solvent to 1 part volume of dispersion) just prior to use to form a single multi-color liquid imaging suspension 14 having an overall black color.

A dark charge exchange surface 13 was prepared by coating and drying to 20–25 micron thickness the following formulation on a NESA glass plate 12:

0.5 gm 2,3,7-trinitro-9-fluorenone 0.5 gm poly(vinyl butyral) containing approximately 9% of polyvinyl alcohol (purchased from Shawinigan Products Corp. under the tradename of Butvar B-76) 30 ml p-dioxane solvent To produce an image, the above-described multicolor suspension was spread on the dark charge exchange surface 13 by the movement of dielectric paper covered conductive roller 10 (having a construction identical to that described in Example 1) proceeding across plate 12 at a velocity of 3–5 cm/sec. and at an electrical bias of +1.5 Kv. A white light exposure through a continuous-tone color positive transparency and then through plate 12 was effected simultaneously with the movement of the conductive roller.

Observations:

The blocking layer 11 of roller 10 exhibited a good quality three-color positive appearing image of the orignal color positive indicating pigment migration or transfer in the unexposed ares of the dark charge exchange surface.

By way of comparison, using the NESA glass substrate alone as an electrode without the dark charge exchange surface, there resulted an image on blocking layer 11 of roller 10 which showed pigment migration or transfer in the exposed areas of the NESA glass electrode. Excessive magenta particle transfer was observed in the red exposed areas.

Example 7: Cyan Monocolor Image without Charge Control Agent

A liquid imaging suspension 14 was prepared by manually mixing the following components in a bottle:

0.1 gm Cyan Blue GTNF 10 ml. Isopar G

This suspension contained a mixture of both positive and negative polarity particles.

A dark charge exchange surface 13 was prepared by coating the following formulation on a NESA glass plate 12:

0.5 gm. 2,4,7-trinitro-9-fluorenone 0.25 gm. Lexan 145 polycarbonate 10 ml. p-dioxane 20 ml. dichloromethane The dark charge exchange surface 13 was air dried to form a layer 8–10 microns thick.

A dielectric paper covered conductive roller identical to that used in Example 1 was held at an electrical bias of +1.5 Kv while moving the roller across the above-described liquid suspension covering the dark charge exchange surface at a rate of 1–2 cm/sec. A simultaneous red light exposure of approximately 2000 foot-candles was made through a black-and-white negative and then through the plate 12.

Observations:

The blocking layer 11 of roller electrode 10 showed that cyan pigment had migrated from the dark charge exchange surface 13 in the background or unexposed areas. However, the pigment particles remained on the dark charge exchange surface in the exposed areas of the surface.

In a control test using NESA glass alone as an electrode without a dark charge exchange surface, the image formed on the NESA glass surface illustrated the migration of pigment particles in the exposed areas and the retention of pigment paticles in the exposed areas of the electrode.

Example 8: Roller Speed Comparison

Separate dispersions of 0.1 gm. of each of Cyan Blue GTNF, Watchung Red B and Indofast Yellow in 35 gm. liquid mixture composed of equal parts by weight of Piccotex 100 and Isopar G were prepared by ball milling each of these pigments in separate bottles. The Cyan Blue GTNF and Watchung Red B dispersions were milled for 36 hours. The Indofast Yellow dispersion was milled for 7 days.

The milled pigment dispersions were rested for 7 days and then combined 5 minutes before use to form a single multicolor liquid imaging suspension 14 by blending together 35 drops of the cyan dispersion, 30 drops of the magenta dispersion and 20 drops of the yellow dispersion.

A dark charge exchange surface 13 was prepared by coating a NESA glass plate 12 with a dispersion of 2,4,7-trinitro-9-fluorenone and Butvar B-76 (1:1 weight ratio) in p-dioxane solvent. A dried coating thickness of 13 microns was obtained.

A dielectric paper 11, as described in Example 1, covered conductive roller 10 biased at +1.5 Kv was used to produce an image by moving the roller across the dark charge exchange surface bearing the multicolor imaging suspension at 5 and 10 cm/sec speeds. Simultaneous with the movement of the roller, a white light exposure (1800 footcandles) was made. The exposure originated from a white light source and proceeded first through color separation filters, i.e., a red Kodak Wratten Filter No. 29 filter or a blue Kodak Wratten Filter No. 47B or a green Kodak Wratten Filter No. 58 which were located in three different exposure areas, then through an image composed of a black-and-white photographic negative transparency, and then through plate 12.

Observations:

The three-colored image formed on the dark charge exchange surface 13 at a roller speed of 5 cm/sec. had a greater image density and better color balance than the image formed at 10 cm/sec. In both cases, the pigment particles in the exposed areas remained on the dark charge exchange surface 13 and pigment particles in unexposed areas migrated to blocking layer 11 mounted on roller electrode 10.

Example 9: Ultraviolet Filtered Exposures with 2,4,7-trinitro-9-fluorenone/Butvar B-76 Dark Charge Exchange Surface Cyan, magenta and yellow pigment dispersions were prepared as in Example 8 and blended together in equal volumes just prior to use to form liquid imaging suspension 14.

A layer of 2,4,7-trinitro-9-fluorenone/Butvar B-76, as in Example 8, was used as dark charge exchange surface 13.

A dielectric paper covered conductive roller, as described in Example 1, biased at +1.0 Kv was moved across the dark charge exchange surface 13 bearing the liquid imaging suspension at a rate of about 3 to 5 cm/sec. A tungsten light exposure was made simultaneously therewith. The exposure first proceeded through a filter arrangement and then through a black-and-white photographic negative and then through surface 13. The filter arrangement consisted of a series of ultraviolet filters, 2E, 2B, 4 and 3, underlying a different Kodak Wratten Filter in each of three different exposure areas. In the first exposure area, a red Kodak Wratten Filter No. 29 was used. In the second exposure area, a blue Kodak Wratten Filter No. 47B was used. In the third exposure area, a green Kodak Wratten Filter No. 58 was used. Although a tungsten exposure has very little UV light component, the UV filters 2E, 2B, 4 and 3 were used to eliminate virtually all of the UV component from the tungsten exposure. This was done to eliminate any possible photoconductive effect in dark charge exchange layer 13 due to the 2,4,7-trinitro-9-fluorenone which is known to be slightly photoconductive to UV light.

Observations:

The images formed on the dark charge exchange surface indicated that there was no migration of the pigment particles in the exposed areas of the dark charge exchange surface. Removal of the ultraviolet light component in the exposure did not appear to affect the migration of pigment particles.

Example 10: Poly(ethylene terephthalate) Dielectric Film Covering Conductive Roller Electrode Cyan, magenta and yellow pigment dispersions were prepared as in Example 8 and blended together in equal volumes just prior to use to form an imaging suspension 14.

A 13 micron thick layer of 2,4,7-trinitro-9-fluorenone/Butvar B-76 dark charge exchange surface coated on a NESA plate 12, as in Example 8, was used as dark charge exchange surface 13.

A 100 micron thick Mylar film (trademark of E. I. duPont deNemours and Co. for polyethylene terephthalate) covering conductive roller electrode 10 was used as blocking layer 11 in place of the dielectric paper used in the previous examples. The roller electrode 10 was biased to a potential of +1.5 Kv relative to surface 13 and rolled across surface 13 bearing suspension 14 at roller velocity of about 5 cm/sec. Simultaneously as in Example 8, a white light exposure was made through plate 12, the exposure first passing through red, green and blue filters in each of three different exposure areas and then through a black-and-white photographic negative before passing through plate 12.

Observations:

The image formed on the Mylar blocking layer 11 mounted on roller electrode 10 indicated that pigment particles migrated from unexposed areas of the dark charge exchange surface 13 to the Mylar film covered roller electrode.

Example 11: Dark Charge Exchange Surface on a Cermet Electrode

The pigment dispersions used to form the multi-color imaging suspension 14 used in this example are identical to those in Example 6 with the exception that they were rested for about 10 days prior to use.

A dark charge exchange surface 13 was prepared by coating equal parts by weight of 2,4,7-trinitro-9-fluorenone and Lexan 145 polycarbonate from dichloromethane solvent onto a cermet conductive support 12. The conductive support 12 was composed of cermet, an optically transparent conductive ceramic material (e.g., SiO.Cr) coated on a poly(ethylene terephthalate) film support. Coating 13 was dried to obtain a dark charge exchange layer thickness of about 15 microns.

To produce an image, a dielectric paper covered conductive roller electrode, as described in Example 1, was maintained at an electrical bias of +1.5 Kv relative to surface 13, and roller 10 was moved across the dark charge exchange surface 13 bearing suspension 14 at a speed of 3–5 cm/sec. with a simultaneous light exposure through red, green and blue filters as in Example 8.

Observations:

The image formed on the roller electrode indicated that cyan, magenta, and yellow pigment particles migrated from the unexposed areas of dark charge exchange surface 13 while exposed pigment particles remained immobilized on the dark charge exchange surface.

Example 12: Three Color Images on Nickelized Poly(ethylene terephthalate) Film

PART A

In Part A of this Example, a three-color liquid imaging suspension 14 containing cyan, magenta and yellow electrically photosensitive particles was made as described in Example 8. A dark charge exchange layer was then made by coating on the conductive surface of an electrode a solution containing one part by weight of 2,4,7-trinitro-9-fluorenone for every 2 parts by weight of Lexan 145 from an organic vehicle of methylene chloride. The electrode consisted of a poly(ethylene terephthalate) film support bearing a thin, electrically conductive substantially transparent evaporated nickel overcoat having an optical density of 0.4.

The above-described liquid imaging suspension and electrode bearing the dark charge exchange surface were then used to form multi-color images in an imaging process and apparatus as described in Example 8 except that the roller electrode was biased at +1.2 Kv relative to the dark charge exchange surface and the roller speed was 1 to 2 cm/sec.

Observations:

Good red, green and blue positive appearing images of the original exposure were formed on the electrically insulating paper covered roller electrode. Good neutral colored background areas also were formed on the paper covered electrode.

PART B

Results similar to those of PART A of this Example were obtained by exposing to white light of approximately 300 footcandles a dark charge exchange layer 13 with the following composition:

2.5 gm 2,4,7-trinitro-9-fluorenone
4.5 gm Lexan 145 polycarbonate
100 gm dichloromethane This composition was coated on unsubbed, 0.4 neutral density, nickelized, poly(ethylene terephthalate) film support and air dried to form a layer about 6 microns thick.

A three-color liquid imaging suspension was made for use with the dark charge exchange surface of PART B by blending the following pigment dispersions:

Cyan pigment dispersion
- 0.5 gm Cyan Blue GTNF
- 150 gm admixture of equal parts by weight of Piccotex 100 and Isopar G
- Milling time - 28 days Magenta pigment dispersion
- 0.5 gm Watchung Red B
- 150 gm admixture of equal parts by weight of Piccotex 100 and Isopar G
- Milling time - 31 days Yellow pigment dispersion
- 0.6 gm Indofast Yellow
- 150 gm admixture of equal parts by weight of Piccotex 100 and Isopar G
- Milling time - 49 days The individual cyan, magenta, and yellow pigment dispersions noted above were ball milled separately for the times noted in 250 ml brown glass bottles filled with 635 gm of 0.32 cm diameter stainless steel balls and then combined in equal volumes just prior to use to form a blended three-color pigment dispersion to be used as liquid imaging suspension 14. This three-color liquid imaging suspension was then used to form a multi-color image in an imaging process and apparatus as described in Example 8 except that the roller electrode 10 was biased at +1.6 Kv relative to the dark charge exchange surface 13 and the roller speed was 1.0 cm/sec.

PART C

Results similar to those of Part B of this Example were obtained when 50 micron thick spacer strips of poly(ethylene terephthalate) were inserted between the dark charge exchange surface and the roller electrode (of Part B) to form a gap therebetween of about 50 microns. The three-color imaging suspension used in Part C of this Example was made by blending a cyan pigment dispersion prepared as illustrated below with the magenta and yellow pigment dispersions prepared as illustrated in Part B of this Example.

Cyan pigment dispersions
- 0.5 gm Cyan Blue GTNF
- 150 gm admixture of equal parts by weight of Piccotex 100 and Isopar G
- Milling time - 31 days This three-color liquid imaging suspension was used to form a multi-color image in an imaging process and apparatus as described in Example 8 except that a white light exposure of 300 footcandles was made through a positive transparency 17 in the absence of color separation filters. The roller electrode was biased at + 1.5 Kv relative to the dark charge exchange surface and the roller speed was about 1.0 cm/sec.

Example 13: Comparison of PIER-PEP Single Color Processes

A cyan pigment dispersion was prepared by mixing the following components in a glass bottle just prior to imaging:

0.05 g Cyan Blue GTNF
20 ml Isopar G

One half of the exposure zone (5.7 cm. by 5.7 cm.) of NESA glass plate 12 was coated with a 20 micron thick layer of a dark charge exchange layer 13 composed of 2,4,7-trinitro-9-fluorenone and a Butvar binder as described in the formulation given in Example 6. The other half of the NESA glass plate 12 was left uncoated.

The above-described cyan pigment dispersion was then applied as a liquid imaging suspension 14 to both the coated and uncoated surfaces of the NESA plate described above. A biased conductive roller electrode bearing a dielectric coated paper, as described in Example 1, was rolled at a speed of about 4 cm/sec. over the area of the NESA plate coated with the cyan dispersion. Using an electrode bias of +1.5 Kv, a simultaneous white light exposure of 1800 footcandles from a tungsten lamp was made through a black-and-white photographic negative modulated with a red Kodak Wratten Filter No. 29. The exposure was made through the NESA plate.

Observations:

The images formed on the dielectric paper covered conductive roller indicated that exposed cyan particles migrated from the uncoated areas of the NESA plate but remained immobilized in the areas of the NESA plate coated with the dark charge exchange layer. Unexposed cyan particles did not migrate from uncoated areas of the NESA plate but did migrate from the areas of the NESA plate bearing the dark charge exchange surface.

Example 14: Comparison of PIER and PEP - Multi-Color Process

Three separate liquid imaging dispersions were prepared as follows:

Cyan Dispersion 0.2 g of Cyan Blue GTNF in 35 g of a mixture composed of equal parts by weight of Isopar G and Piccotex 100 was milled for three weeks in a 60 ml. brown glass jar filled to one-half volume with 0.32 cm. diameter stainless steel balls.

Magenta Dispersion

This dispersion was made using Watchung Red B pigment, Piccotex 100 and Isopar G in the same manner as the above-described cyan dispersion.

Yellow Dispersion

This dispersion was made using Indofast Yellow, Piccotex 100 and Isopar G in the same manner as the above-described cyan dispersion except that milling was carried out for a longer period, approximately 2 months.

Equal volumes of each the cyan, magenta and yellow dispersions described above were then admixed together, just prior to imaging, to form a single multi-colored pigment particle-containing liquid imaging suspension. This blended multi-colored suspension was then applied over the conductive surfaces of two NESA plates. One of the conductive NESA plate surfaces had previously been covered with a dark charge exchange layer composed of 1 part by weight 2,4,7-trinitro-9-fluorenone and 2 parts by weight of Lexan 145. The other conductive NESA plate surface was covered solely with the liquid imaging suspension and had no dark charge exchange surface. Imaging was carried out on both NESA plates as follows: an 1800 footcandle white light exposure was projected through a photographic color transparency and through the NESA plate to the blended multi-color imaging suspension. Simultaneously with exposure, a biased dielectric paper covered conductive roller, as described in Example 1, was moved at a rate of about 0.5 to 1.0 cm/sec. across the blended imaging suspension through the exposure zone thereof. The roller was biased to +1.3 Kv. relative to the NESA plate.

Observations:

A multi-color positive-appearing image corresponding to the original color transparency was formed on the dielectric paper covering the conductive roller which was used in combination with the NESA plate bearing the dark charge exchange surface. This was a PIER image since the pigment particles in the exposed areas had been immobilized on the dark charge exchange surface of the NESA plate while the particles in the unexposed areas had migrated to the dielectric paper to form, by subtractive color formation, a positive appearing image of the original color transparency.

A multi-color negative-appearing image of the original color transparency was formed on the dielectric paper covering the conductive roller which was used in combination with the NESA plate which had no dark charge exchange surface. This was a PEP image since the pigment particles in the exposed areas had migrated to the dielectric paper to form, by subtractive color formation, a negative appearing image.

Example 15: Comparison of PIER and PEP at Increased Exposure

PART A

A cyan pigment dispersion prepared as described in PART B of Example 12 was used as a liquid imaging suspension on a dark charge exchange surface prepared as described in PART B of Example 12 on unsubbed, 0.4 neutral density, nickelized, poly(ethylene terephthalate) film support. In PART A of this example the dark charge exchange surface was employed in an apparatus as shown in FIG. 6 except that filters 18 and 19 were removed and a black-and-white negative test pattern 17 with clear letter areas was interposed between a 0.3 neutral density step tablet with 10 steps of 6mm width (not shown in FIG. 6) and light source 16, ie. a tungsten lamp. A 4000 footcandle tungsten white light exposure was made through the step tablet and the test pattern 17 while maintaining dielectric paper covered roller electrode 10 at a potential of +1.6 Kv relative to dark charge exchange surface 13 and a roller speed of about 1.0 cm/sec.

Observations: PART A (PIER)

A good image of the same image sense as the test pattern was formed on the blocking layer 11 of roller electrode 10 at exposure levels ranging from about 4000 footcandles through less than about 300 footcandles, thereby indicating PIER operation. At every exposure level, including no exposure, the pigment particles in the unexposed areas migrated from the dark charge exchange surface to the blocking layer of the roller electrode.

PART B

The same cyan liquid imaging suspension of PART A was used on a PEP type electrode surface, ie. 0.4 neutral density, nickelized poly(ethylene terephthalate) film support. This surface did not exhibit dark charge exchange properties. This PEP type electrode bearing the cyan liquid imaging suspension was then employed in an apparatus as shown in FIG. 6 in a manner identical to that described in PART A of this example. (Of course, dark charge exchange layer 13 of FIG. 6 was deleted.) The dielectric paper covered roller electrode 10 was biased at +1.4 Kv relative to the nickel conducting layer 12.

Observations: PART B (PEP)

In "overexposed", ie. high light intensity areas there was some evidence that certain portions of the image formed on blocking layer 11 of roller 10 exhibited the same image sense as the original image. However, as the light exposure was diminished to more acceptable levels by the step tablet it was apparent that for exposure levels below the 0.9 neutral density step (plus the 0.4 neutral density nickel layer) the image sense on the blocking layer was the reverse of the original indicating conventional PEP operation. Under the high light intensity (overexposed) conditions the images formed on blocking layer 11 of roller 10 were generally of poor quality and exhibited the following characteristics: the images contained relatively clear background (non-letter) areas in which unexposed particles did not migrate from the nickelized film support and discernible, generally denser, letter areas. However, certain portions of these letter areas appeared partially clear indicating that exposed particles apparently migrated from the nickelized film support to the blocking layer of the roller electrode as in normal PEP operation and then subsequently migrated backwards from these letter areas on the blocking layer of the roller electrode to the nickelized film support.

In summary, in the PEP mode of operation (Part B of this example) there was observed a tendency towards a partial switching of image sense which occurred when exposing at a high light intensity. However, this change in image sense did not indicate PIER operation because, as illustrated in Part A of this example, in actual PIER operation, images of the same image sense as the original are formed at the roller electrode at normal and low exposure levels and in total darkness as well as under high intensity exposure conditions.

Example 16

In this example a series of imaging tests were presented to illustrate certain characteristics of the dark charge exchange layer used in PIER, for example, the importance of using a sufficient amount of a dark charge exchange material, such as 2,4,7-trinitro-9-fluorenone, to obtain PIER operation, rather than conventional PEP operation.

In each of the following imaging tests A–E, the following test conditions were employed:

Blocking layer 11 covering conductive roller electrode 10 was a dielectric paper. The roller electrode and dielectric paper used were identical to that described in Example 1. The liquid imaging suspension 14 used was composed of 0.1 gm. of finely-divided particles of Cyan Blue GTNF pigment estimated to have an average diameter on the order of about 0.5 – 1 micron dispersed (by mixing) in 20 gm. of Sohio Odorless Solvent 3440. Exposure pattern 17 consisted of a black and white negative photographic transparency of printed matter, the printed matter appearing as clear areas of the transparency. Light source 16 was a tungsten source. The exposure intensity on the imaging plane of the liquid imaging suspension was about 1000 foot-candles. Activating radiation from source 16 first passed through a single filter, i.e., Kodak Wratten Filter No. 29, before passing through exposure pattern 17. Electrode 12 was a NESA glass plate. Conductive roller electrode 10 was biased during imaging to about + 1200 volts relative to electrode 12. Roller speed of conductive roller electrode 10 during imaging was on the order of about 0.5–2.0 cm./sec.

In each test, dark charge exchange layer 13 was varied as indicated below to illustrate the effect of certain physical parameters on the dark charge exchange layer.

Test A

In this test, no dark charge exchange layer was employed. A thin film of liquid imaging suspension 14 was applied directly to the conductive tin oxide surface of electrode 12. As was expected, conventional PEP imaging was produced by this test; that is, a negative appearing image of exposure pattern 17 was recorded on blocking layer 11 and a positive appearing image of exposure pattern 17 was recorded on electrode 12.

Test B

In this test, a mixture composed of 0.03 parts by weight of 2,4,7-trinitro-9-fluorenone admixed in 500 parts by weight of Sohio Odorless Solvent 3440 was coated and dried on electrode 12. Most of the Sohio solvent evaporates during drying. This layer, when tested for dark charge exchange properties, showed no dark charge exchange capability; that is, a negative-appearing image of exposure pattern 17 was formed on blocking layer 11 and a positive-appearing image of pattern 17 was formed on the above-described layer containing a very small amount of 2,4,7-trinitro-9-fluorenone. As a result of this test it was concluded that an insufficient amount of 2,4,7-trinitro-9-fluorenone was applied to electrode 12 to provide PIER operation.

Test C

In this test a very thin layer having a dry thickness of less than about 3 microns was coated on electrode 12. This layer consisted of approximately equal parts by weight of 2,4,7-trinitro-9-fluorenone and Lexan 145 coated from methylene chloride. The results of this imaging tests showed a mixture of both PEP and PIER operation occurring; that is, certain areas of the image obtained on blocking layer 11 were a negative-appearing image of exposure pattern 17 (thus indicating conventional PEP operation in these areas) whereas other areas of the image obtained on blocking layer 11 were a positive-appearing image of exposure pattern 17 (thus indicating PIER operation in these areas). It was concluded as a result of Test C that the 3 micron layer used was so thin that it contained an insufficient amount of the dark charge exchange material 2,4,7-trinitro-9-fluorenone to provide complete PIER operation.

Tests D-1 and D-2

In these two tests, two layers much thicker than the 3 micron layer of Test C were applied to electrode 12. The layers used in Test D-1 and D-2 were composed of 0.03 parts by weight of 2,4,7-trinitro-9-fluorenone and 4 parts by weight of Lexan 145. The layers were solvent coated from methylene chloride. The layer of Test D-1 had a dry thickness of about 30 microns and the layer of Test D-2 had a dry thickness of about 75 microns (i.e., about 3 mils). In both tests D-1 and D-2, conventional PEP imaging was obtained as indicated by the negative-appearing image of exposure pattern 17 formed on blocking layer 11. Both images were of relatively poor quality, the image obtained in Test D-2 being barely discernible.

Test E

In this test a layer composed of 2,4,7-trinitro-9-fluorenone and Lexan 145 was coated from methylene chloride onto electrode 12 to form a layer having a dry thickness of 13 microns and having a dry composition consisting of 1 percent by weight of 2,4,7-trinitro-9-fluorenone and 99 percent by weight of Lexan 145. The image obtained using this layer coated on electrode 12 was a conventional PEP images; no PIER operation was evident. That is, a negative-appearing image of exposure pattern 17 was formed on blocking layer 11 and a positive-appearing image of pattern 17 was formed on the 2,4,7-trinitro-9-fluorenone layer coated on electrode 12. From this test, it was concluded that an insufficient amount of 2,4,7-trinitro-9-fluorenone was used in the layer coated on electrode 12 so that merely conventional PEP imaging was obtained.

Example 17 Concentration of 2,4,7-trinitro-9-fluorenone in a Representative Dark Charge Exchange Layer Five different layers were prepared for testing as dark charge exchange layer 13 with 2,4,7-trinitro-9-fluorenone (TNF) at 35.7%, 26.8%, 17.6%, 8.8% and 0% of the total solids in each layer according to the formulations listed below. The purpose of this example is to illustrate the importance of using the proper amount of a dark charge exchange material in a dark charge exchange layer.

Formulation 1:
- 2.5 gm TNF
- 4.5 gm Lexan 145 polycarbonate
- 100 gm. dichloromethane Formulation 2:
- 1.88 gm TNF
- 5.12 gm Lexan 145
- 100 gm dichloromethane Formulation 3:
- 1.25 gm TNF
- 5.75 gm Lexan 145
- 100 gm dichloromethane Formulation 4:
- 0.625 gm TNF
- 6.375 gm Lexan 145
- 100 gm dichloromethane Formulation 5:
- 7.0 gm Lexan 145
- 100 gm dichloromethane The formulations were hand coated with a 0.006 mil coating knife at a wet thickness of 150 microns on unsubbed 0.4 neutral density, nickelized, poly(ethylene terephthalate) film support at a coating block temperature of 21°C. The coatings were air dried at room temperature.

A cyan pigment dispersion was prepared as described in Part B of Example 12 and was used as a liquid imaging suspension in an imaging process and apparatus as described in Example 7 except that the roller electrode bias was + 1.6 kv, the roller speed was 1.0 cm/sec., the white light exposure was about 1000 footcandles and a 0.3 neutral density step tablet with 10 steps of 6 mm width was used to modify the exposure. Due to electrical breakdown, the test of the layer produced from Formulation 5 containing no TNF was modified in that the roller electrode bias was lowered to + 1.3 Kv. and the white light exposure was lowered to about 900 footcandles. Before using the cyan dispersion, the pigment particles were allowed to settle for about 6 weeks after which 50 gm of the supernatant liquid was decanted. The remaining dispersion was hand mixed just prior to use in the imaging process.

Observations:

At 35.7% by weight of TNF in layer 13 (Formulation 1 above) the blocking layer 11 of the roller electrode showed a good image of the same image sense as the original. This TNF-containing-layer had an image of opposite sense from the original and this image, when electrostatically transferred to a receiver sheet, had a very low background density indicating that this TNF-containing-layer was acting as a dark charge exchange surface by exchanging charge with the cyan pigment in unexposed areas. This test indicated PIER operation.

At 26.8% by weight of TNF (Formulation 2 above) the blocking layer 11 of the roller electrode showed a good image of the same image sense as the original. The image transferred to a receiver sheet from this TNF-containing-layer had an opposite image sense from the original and showed a low background density though it was somewhat higher than the previous test. This test indicated PIER operation.

At 17.6% by weight of TNF (Formulation 3 above) the blocking layer of the roller electrode showed a poor image of the opposite image sense as the original. There was observable density in the letter areas and low background density indicating a PEP mode of operation. This TNF-containing-layer had a poor image also of the opposite image sense as the original. The electrostatic transfer record of this TNF-containing-layer image showed high density background areas surrounding higher density letter areas.

At 8.8% by weight of TNF (Formulation 4 above) the blocking layer of the roller electrode showed an image of opposite image sense from the original indicative of PEP operation. The image electrostatically transferred to a receiver sheet from this TNF-containing-layer also had an opposite image sense from the original and, as in the previous test, showed high background density. This TNF-containing-layer was not acting as a dark charge exchange surface. The inability of the above-noted 17.6% TNF-containing-layer and this 8.8% TNF-containing layer to adequately exchange charge with the cyan pigment particles in the unexposed (i.e. background) areas indicated that these layers at these TNF concentration levels were not acting as dark charge exchange layers.

At 0% of TNF (Formulation 5 above) the blocking layer of the roller electrode showed an image of opposite image sense from the original indicative of PEP operation. The results showed a partial tendency for the same image sense as the original occurring on the blocking layer of the roller electrode in overexposed, i.e. high exposure, areas. The image electrostatically transferred to a receiver sheet from the 0% TNF-containing-layer had a poor image of the same image sense as the original, again indicative of PEP operation. At high exposure areas the results indicated a partial tendency for the opposite image sense from the original occurring on this transfer record. These results illustrated that the layer containing Lexan 145 only is not acting as a dark charge exchange surface.

Example 18 Pigment Speed Test—Three-Color

This test was intended to determine if any speed differences existed between the cyan, magenta and yellow pigment particles of a typical multicolor liquid imaging suspension used in PIER.

A multicolor liquid imaging suspension was prepared by mixing cyan, magenta and yellow pigment dispersions prepared as described in Part B of Example 12.

A dark charge exchange surface was also prepared as described in Part B of Example 12.

The liquid imaging suspension and the electrode bearing a dark charge exchange surface were then used to form separate color images in an imaging process and apparatus as described in Example 8 except that the roller electrode was biased at +1.2 Kv, the roller speed was 1.0 cm/sec and the exposure was approximately 800 footcandles. The exposure originated from a tungsten white light source and proceeded first through color separation filters, i.e., a red Kodak Wratten Filter No. 29 or a green Kodak Wratten Filter No. 58 or a blue Kodak Wratten Filter No. 47B which were located in alternating bands of 0.32 cm width across the entire exposure area, then through an image composed of a step tablet with 6 mm wide, 0.3 neutral density steps, then through the NESA glass plate, and finally through the dark charge exchange layer to the liquid imaging suspension.

Observations:

The image formed on the blocking layer of the roller electrode had the same image sense as the original. The red, green, blue and neutral areas were good quality. Dense neutral tones opposite the highest density steps were expected because the low exposure favors the migration of all of the pigment particles from the dark charge exchange surface to the roller electrode. As noted previously, one of the advantages of PIER is that it provides excellent reproduction of neutral tones.

The image electrostatically transferred to a receiver surface from the dark charge exchange surface showed an image sense opposite from the original. This transfer record of the image formed on the dark charge exchange surface indicated that the cyan and magenta pigment particles had about the same number of visible steps or the same speed for the conditions of this test. The yellow pigment particles appeared to be about three steps slower in speed than either the cyan or magenta pigment particles. A faint step in the red and green low exposure areas was visible on the transfer record at an exposure level of about 2.5 footcandles. This indicated that for the conditions of this test there was a threshold sensitivity of at least 2.5 footcandles exposure.

Example 19 Electrical Bias Changes

Two identical dark charge exchange surfaces were prepared as described in Part B of Example 12. One surface was used for imaging tests at roller electrode biases of +250 V, +350 V, and +650 V. The other surface was tested at +600 V, +900 V, +1400 V, +2000 V, and +2500 V.

A cyan pigment dispersion was prepared as described in Part B of Example 12 and was used as a liquid imaging suspension in an imaging process and apparatus as described in Example 7 except that the roller electrode bias was varied from +250 V to +2500 V, the roller speed was 1.0 cm/sec and the white light exposure was about 350 footcandles.

Observations:

At each roller electrode bias the image formed on the blocking layer of the roller electrode had the same image sense as the original indicating PIER operation. As the roller electrode bias was increased from +250 V to +2500 V there was an observable increase in the density of the image formed on the blocking layer of the roller electrode.

Example 20 NIP Exposure of PIER

A dark charge exchange surface was prepared as described in Part B of Example 12.

A cyan pigment dispersion was prepared as described in Part B of Example 12 and was used as a liquid imaging suspension in an imaging process and apparatus as described in Example 7 except that the roller electrode bias was +1.6 KV, the roller speed is 1.0 cm/sec and the exposure was about 500 footcandles directed at the nip formed between the roller electrode and the liquid imaging suspension. To obtain the nip exposure an 800 H Kodak Carousel Projector was used as the exposure source and was directed at about a 45° angle from the horizontal towards the nip of the roller electrode as illustrated diagrammatically in FIG. 7. Simultaneously with the nip exposure, the biased roller electrode was moved across the dark charge exchange surface.

Observations:

In the test of the dark charge exchange surface the image formed at the roller electrode was the same image sense as the original indicating PIER operation.

The nip exposing technique illustrated in this example shows that, if desired, both of the spaced electrodes can be opaque in PIER.

Example 21 Pigment Concentration Series

Table 3

| Dispersion No. | Pigment | Weight of Pigment in Dispersion | Milling Time |
|---|---|---|---|
| 1 | Cyan Blue GTNF (CB) | 0.1 gm. | 28 days |
| 2 | Indofast Yellow (IY) | 0.1 | 28 |
| 3 | Watchung Red B (WR) | 0.1 | 28 |
| 4 | CB | 0.2 | 28 |
| 5 | IY | 0.2 | 28 |
| 6 | WR | 0.2 | 28 |
| 7 | CB | 0.3 | 28 |
| 8 | IY | 0.3 | 28 |
| 9 | WR | 0.3 | 28 |
| 10 | CB | 0.4 | 28 |
| 11 | IY | 0.4 | 28 |
| 12 | WR | 0.4 | 28 |
| 13 | CB | 0.5 | 28 |
| 14 | IY | 0.5 | 28 |
| 15 | WR | 0.5 | 28 |
| 16 | CB | 0.6 | 28 |
| 17 | IY | 0.6 | 28 |
| 18 | WR | 0.6 | 28 |
| 19 | CB | 0.7 | 28 |
| 20 | IY | 0.7 | 28 |
| 21 | WR | 0.7 | 28 |
| 22 | CB | 0.8 | 28 |
| 23 | IY | 0.8 | 28 |
| 24 | WR | 0.8 | 28 |
| 25 | CB | 0.9 | 33 days |
| 26 | IY | 0.9 | 33 |
| 27 | WR | 0.9 | 33 |
| 28 | CB | 1.0 | 33 |
| 29 | IY | 1.0 | 33 |
| 30 | WR | 1.0 | 33 |
| 31 | CB | 1.1 | 33 |
| 32 | IY | 1.1 | 33 |
| 33 | WR | 1.1 | 33 |

Cyan, magenta and yellow pigment dispersions were prepared according to the weights and milling times given in Table 3 above. Each dispersion was milled in a small brown bottle containing a 35gm liquid mixture of equal parts by weight of Piccotex 100 and Isopar G and 240 gm of 0.32 cm diameter stainless steel balls.

Blended dispersion, i.e., cyan, magenta and yellow dispersions blended together, were prepared at various pigment concentrations as illustrated in Table 4 below.

Table 4

| Blended Dispersion No. | Table 3 Pigment Dispersion Nos. | Total Pigment Concentration in Blended Dispersion (weight %) |
|---|---|---|
| 1 | 1, 2, 3 | 0.3% |
| 2 | 4, 5, 6 | 0.6 |
| 3 | 7, 8, 9 | 0.9 |
| 4 | 10, 11, 12 | 1.2 |
| 5 | 13, 14, 15 | 1.5 |
| 6 | 16, 17, 18 | 1.7 |
| 7 | 19, 20, 21 | 2.0 |
| 8 | 22, 23, 24 | 2.2 |
| 9 | 25, 26, 27 | 2.5 |
| 10 | 28, 29, 30 | 2.8 |
| 11 | 31, 32, 33 | ~3.1 |

The blended dispersions were used as liquid imaging suspensions on a dark charge exchange surface prepared as described in Part B of Example 12.

The liquid imaging suspensions were used to form multi-colored images in an imaging process and apparatus as described in Example 8 except that the roller electrode was biased +1.6 Kv relative to the dark charge exchange surface the roller speed was 1.0 cm/sec. and the white light exposure was about 320 footcandles. Blended dispersion No. 11 was also tested at a roller electrode bias of +2.0 Kv.

Observations:

At all pigment concentrations tested, i.e., 0.3% – 3.1%, the images formed on the blocking layer of the roller electrode had the same image sense as the original, indicating PIER operation. The results showed that image density increased with increasing pigment concentration. Good quality images were observed at about 0.3% to about 2.1% pigment levels.

The dark charge exchange surface had a good quality image of opposite sense from the original and this image showed a very low background density. At pigment concentrations higher than 2.1%, the image on the blocking layer of the roller electrode and the image of opposite image sense on the dark charge exchange surface showed higher background densities. Improved image quality and lower background density using these higher pigment concentration suspensions was achieved by increasing the electrical bias on the roller electrode as evidenced by the testing of blended dispersion No. 11 at +2.0 Kv.

Example 22 2,4,5,7-tetranitro-9-fluorenone as a dark charge exchange material A dark charge exchange surface was prepared from the formulation:

2.5 gm 2,4,5,7-tetranitro-9-fluorenone
4.5 gm Lexan 145 polycarbonate
100 gm dichloromethane Some undissolved solids were allowed to settle out. The dissolved portion of the formulation was coated on unsubbed, 0.4 neutral density, nickelized, poly(ethylene terephthalate) film support at a wet thickness of about 150 microns. The coating was allowed to dry in air at room temperature.

Cyan, magenta and yellow pigment dispersions were prepared as described in Part B of Example 12 except that the magenta pigment dispersion was ball milled for 28 days and the yellow pigment dispersion ball milled for 81 days.

A blended dispersion was prepared by mixing equal volumes of each of the cyan, magenta and yellow pigment dispersions. This three-color, liquid imaging suspension was used to form a multi-color image in an imaging process and apparatus as described in Example 8 except that the roller electrode was biased at +1.6 Kv relative to the dark charge exchange surface, the roller speed was 1.0 cm/sec and the white light, tungsten exposure was 900 footcandles through 1.0 and 2.0 neutral density filters (in separate imaging tests), through a positive color transparency and through the 0.4 neutral density, nickel, conducting layer on the film support.

Observations:

A good image of the same image sense as the original appeared on the blocking layer of the roller electrode indicating PIER operation. This test illustrated that 2,4,5,7-tetranitro-9-fluorenone was acting as a dark charge exchange material by allowing pigment particles to migrate from the unexposed areas of the dark charge exchange surface to the blocking layer of the roller electrode.

Example 23 9-(Dicyanomethylene)-2,4,7-trinitrofluorene as a dark charge exchange surface A dark charge exchange surface was prepared from the formulation:

1.0 gm 9-(Dicyanomethylene)-2,4,7-trinitrofluorene
2.25 gm Lexan 145 polycarbonate
100 gm tetrahydrofuran This formulation was coated as described in Example 22 except that the coating block temperature was held at 27°C.

Cyan, magenta and yellow pigment dispersions were prepared and mixed to form a blended dispersion as described in Example 22. This three-color, liquid imaging suspension was used in the imaging process and apparatus described in Example 22.

Observations:

Results were similar to those obtained in Example 22. This test illustrated that 9-(Dicyanomethylene)-2,4,7-trinitrofluorene acted as a dark charge exchange material.

Example 24 Methyl-2,7-dinitro-9-flurenone carboxylate as a dark charge exchange material A dark charge exchange surface was prepared from the formulation:

1.0 gm Methyl-2,7-dinitro-9-fluorenone carboxylate
1.8 gm Lexan 145 polycarbonate
50 gm Tetrahydrofuran This formulation was coated in the manner described in Example 22.

The three-color liquid imaging suspension, imaging process and apparatus were the same as described in Example 22.

Observations:

Results were similar to those obtained in Example 22. This test illustrated that methyl-2,7-dinitro-9-fluorenone carboxylate acted as a dark charge exchange material.

Example 25 2-Dicyanomethylene-1,3-indandione as a dark charge exchange material

A dark charge exchange surface was prepared from the formulation:

0.4 gm 2-dicyanomethylene-1,3-indandione
0.6 gm Lexan 145 polycarbonate
14.4 gm Tetrahydrofuran This formulation was coated in the same manner as the formulation described in Example 22.

A cyan pigment dispersion prepared as illustrated in Part B of Example 12 was used as a liquid imaging suspension in the imaging process and apparatus described in Example 22.

Observations:

Results were similar to those obtained in Example 22. This test illustrated that 2-dicyanomethylene-1,3-indandione acted as a dark charge exchange material.

Example 26 Polyester Binder used in Dark Charge Exchange Layer

Two different dark charge exchange layers were prepared from the following formulations:

Formulation 1:

3.0 gm 2,4,7-trinitro-9-fluorenone
4.0 gm polyester
100 gm dichloromethane

Formulation 2:

2.5 gm 2,4,7-trinitro-9-fluorenone
4.5 gm polyester
100 gm dichloromethane

These formulations were coated on unsubbed, 0.4 neutral density nickelized poly(ethylene terephthalate) film support at a wet thickness of about 150 microns and a coating block temperature 16°C. The coatings were allowed to air dry overnight at room temperature.

Cyan, magenta and yellow pigment dispersions were prepared as described in Part B of Example 12 except that the magenta pigment dispersion was ball milled for 28 days.

A blended dispersion was prepared by mixing equal volumes of each of the cyan, magenta and yellow pigment dispersions. This three-color liquid imaging suspension was held for 24 hours in darkness and used in an imaging process and apparatus as described in Example 8 except that the roller electrode was biased at +1.6 Kv, the roller wpeed was 1.0 cm/sec., and the white light exposure was 800 footcandles through a multi-color transparency.

Observations:

A good multi-color image of the same image sense as the original appeared on the roller electrode, indicating PIER operation.

The invention has been described in detail with particular reference to certain preferred embodiments thereof, but it will be understood that variations and modifications can be effected within the spirit and scope of the invention.

Example 27 - PIER Process Without A Blocking Layer

In accord with one embodiment of PIER, as noted earlier herein, it is preferred that one of the electrodes used in PIER bear a blocking layer on its surface. However, acceptable results can also be obtained in the PIER process without the use of a conventional blocking layer. In this example, the PIER process was carried out employing an electrode configuration using a dark charge exchange surfaced electrode similar to that illustrated in FIG. 6 and described in Example 14, except that no blocking layer 11 was used. Instead, in this example, the surface of electrode 10 of FIG. 6 was modified and, in one case, consisted of a conductive material, namely a poly(ethylene terephthalate) film support bearing a thin layer of vacuum-evaporated nickel having an optical density of 0.4, and, in another case, consisted of a dark charge exchange layer having a composition similar to the dark charge exchange surface described in Example 14. (Thus, in the latter case, both of the electrodes used in the electrode configuration possessed dark charge exchange surfaces.) To test the PIER process using electrode 10 having the above-described modified surface properties, a three-color liquid imaging suspension 14 containing cyan, magenta, and yellow electrically photosensitive particles was prepared in a manner similar to that described in Example 14; and this three-color imaging suspension was used in an imaging process similar to that described in Example 14 to determine if each of the above-described electrode configurations could yield acceptable PIER image formation. The roller speed of electrode 10 used in this example was approximately 1 to 2 cm./sec.

Observations:

Both of the modified electrode configurations tested above exhibited PIER image formation. That is, in the case where the surface of electrode 10 consisted of a conductive evaporated nickel layer and in the case where the surface of electrode 10 consisted of a dark charge exchange layer, it was found that there was obtained red, green, and blue positive appearing images of the original exposure on the surface of electrode 10 and complementary negative appearing color images of the original exposure on the dark charge exchange surface 13.

Example 28 Multiple Pass Process

This example illustrates a further embodiment of PIER for increasing image density in situations where it may be desired to do so. It has been found that increased image densities can be obtained in PIER processes by passing the electrode opposite the dark charge-exchange surfaced electrode, for example, roller electrode 10 in the PIER imaging apparatus of FIG. 6, two or more times over the dark charge exchange surfaced electrode bearing a suitable imaging suspension. This "multiple pass" imaging process increases the density of the image formed on the surface of the electrode opposite the dark charge exchange surfaced electrode and may be accomplished by the following sequence of steps:

1. forming an image on the electrode surface opposite the dark charge exchange electrode using a conventional PIER process as described, for instance, in Part B of Example 12;
2. removing any image and any remaining imaging suspension from the surface of the dark charge exchange electrode;
3. applying fresh imaging suspension to the cleaned surface of the dark charge exchange electrode;
4. repeating step (1) above one or more times to apply, in registration, additional layers of image-forming particles on top of the original image formed on the surface of the electrode opposite the dark charge exchange electrode in step. (1).

This embodiment of PIER was demonstrated using the following materials and apparatus:

A dark charge exchange surface was prepared by coating Dispersion A given below, on the conductive surface of an electrode composed of a poly(ethylene terephthalate) film support bearing a thin, electrically conductive, substantially transparent, evaporated nickel overcoat having an optical density of 0.4.

Dispersion A 50.25 gm 2,4,7-trinitro-9-fluorenone (TNF)
80.40 gm Lexan 145 Bisphenol-A polycarbonate sold by General Electric
2010.00 gm 60/40 mixture by weight of dichloromethane/1,2-dichlorethane
6.5% total solids Dispersion A was coated on the electrode at a coverage of 0.325 gm/sq. ft. and dried. The dried coating was coated again with the same dispersion at the same coverage and dried to obtain a final dark charge exchange layer thickness of 5–10 microns.

A multicolor liquid imaging suspension was prepared by mixing together in equal volumes the following pigment dispersions:

Cyan Pigment Dispersion 0.5 gm Cyan Blue GTNF
150 gm admixture of equal parts by weight of Piccotex 100 and Isopar G
Milling time - 30 days Magenta Pigment Dispersion 0.5 gm watchung Red B
150 gm admixture of equal of equal parts by weight of Piccotex 100 and Isopar G
Milling time - 30 days Yellow Pigment Dispersion 0.6 gm Indofast Yellow
150 gm of an admixture composed of 2 parts by weight of Piccotex 100 to 3 parts by weight of Isopar G
Milling time - 81 days The pigment dispersions were individually ball milled in 250 ml brown glass bottles each containing 635 gm of 0.32 cm diameter stainless steel balls. The milling rate was about 33 cm/sec.

The above-described multicolor liquid imaging suspension and dark charge exchange surfaced electrode were used in a migration imaging apparatus similar to that illustrated in FIG. 6. A dielectric paper covered, aluminum roller electrode as described in Example 1 was used as blocking layer 11 and conductive roller electrode 10 of the apparatus shown in FIG. 6.

Multiple pass imaging was accomplished by the following sequence of steps:

1. A first image was formed on the dielectric paper covered, roller electrode by the PIER process. Specifically, the paper covered roller electrode was rolled at a rate of 1.0 cm/second across the dark charge exchange surface bearing the nulticolor liquid imaging suspension. Simultaneous with the movement of the electrode, an electrical potential of +1.6 Kv was applied to the roller and a 1500 foot candle white light exposure was made through a positive color transparency and through the dark charge exchange imaging electrode to the liquid imaging suspension. The color image formed on the paper covered roller electrode had the same image sense as the original transparency, thus indicating PIER imaging.
2. The liquid imaging suspension remaining on the dark charge exchange surface was removed by swabbing the surface with a tissue paper soaked in Isopar G. During the cleaning of the dark charge exchange surface, the paper covered roller electrode was held motionless at the edge of the surface. It was important to prevent the roller electrode from slipping in order to achieve good image registration during the subsequent pass of the roller electrode made in step 4.
3. Fresh multicolor liquid imaging suspension was applied on the cleaned dark charge exchange surface.
4. The imaging process described in step 1 was repeated using the image-bearing, paper-covered roller electrode of step 1, except that the direction of movement of the roller electrode was reversed.

Observations:

The final positive image formed on the paper covered roller electrode as the result of making two passes of the roller electrode was a high density, good quality, multicolor image.

Similar results were obtained when three passes of the roller electrode were made. Neutral optical density measurements obtained from the image formed after each pass are tabulated below.

| Number of Passes | Neutral Density |
|---|---|
| 1 | 0.40 |
| 2 | 0.75 |
| 3 | 1.10 |

Example 29 Dry PIER Process

In this example the PIER process of the invention is illustrated using dry, finely-divided photosensitive pigment particles, rather than the liquid imaging suspension used in the previous examples. In this example, a dry, photosensitive pigment powder was prepared by ball milling Cyan Blue GTNF pigment particles in 75 ml. brown bottles using 0.32 cm. stainless steel balls for a period of two weeks.

Following the milling of the Cyan Blue GTNF pigment particles, the resultant dry pigment powder was applied to the surface of the dark charge exchange electrode in an imaging apparatus of the type shown in FIG. 6 and similar to that which is specifically described in previous Example 15, Part A. In particular, the dark charge exchange layer used in the imaging apparatus of this example was about 12 microns thick and consisted of about 0.3 parts by weight of 2,4,7-trinitro-9-fluorenone and 1.0 part by weight of Lexan 145 polycarbonate. In addition, filters 18 and 19 shown in FIG. 6 were removed from the imaging apparatus used in this example and a black-and-white negative test pattern 17 with clear letter areas was interposed between light source 16 and electrode 12. Light source 16 was a tungsten lamp situated to provide a 2000 footcandle exposure. Of course, liquid imaging suspension 14 shown in FIG. 6 was replaced in this example by the above-described dry Cyan Blue GTNF pigment powder. This dry, milled pigment powder was applied to the surface of dark charge exchange layer 13 by sprinkling the dry milled powder from a 50 ml. brown bottle having a cap with holes drilled by a No. 55 drill. As a result, a non-uniform layer of pigment powder was applied to the surface of layer 13. The layer of pigment powder on layer 13 was then brushed with a camel hair brush to remove non-uniformities and to break up clumps in the layer of pigment powder. The thickness of the layer of cyan pigment powders was adjusted to obtain a layer exhibiting a density to red light of from about 0.2 to 0.3. The resultant layer of pigment powder had acquired, by virtue of triboelectric interaction, a positive charge. Subsequently, roller 10 bearing blocking layer 11 was rolled over the pigment-bearing surface of layer 13 and simultaneously a field was applied across the roller nip and an imagewise 2000 footcandle exposure using the above-described black-and-white test pattern was effected. The field applied was a +1.0 kv. field with roller 10 biased positively relative to electrode 12.

Observations:

As a result of the PIER imaging process described above, a negative-appearing image of the original test pattern was formed on dark charge exchange layer 13; that is, cyan powder colored letter areas were produced on layer 13 indicating that in areas of light exposure the photosensitive pigment particles had been immobilized on the surface of dark charge exchange layer 13.

EXAMPLE 30 Movement of the Imaging Electrode in a a Sliding Movement at a Higher Rate than that of the Receiving Electrode.

This example illustrates another embodiment of the PIER process for improving the image density and quality of the image produced on the receiving electrode. It has been found that an improved image density and quality can be obtained in the PIER process by moving the dark charge-exchange surfaced electrode bearing a liquid imaging suspension thereon, at a translational velocity which is greater than the translational velocity of the image receiving electrode, for example, the roller electrode 10 in the PIER imaging apparatus of FIG. 6.

In this embodiment of PIER, a dark charge-exchange surfaced electrode and cyan, magenta and yellow pigment dispersions were prepared as in Example 28.

The above-described, multicolor liquid imaging suspension and dark charge-exchange surfaced electrode were used in a migration imaging apparatus similar to that illustrated in FIG. 6. A dielectric paper covered conductive roller as described in Example 1 was used as the blocking layer 11 and conductive roller electrode 10 of the apparatus shown in FIG. 6, and was spaced to a gap of about 50 microns above the dark charge-exchange surface by inserting poly(ethylene terepthalate) film spacer strips at the edges of the roller 10 between the dark charge-exchange surface and the roller.

Imaging was accomplished by simultaneously moving the paper covered roller electrode at a translational velocity of about 1.0 cm/sec across the dark charge-exchange surface bearing the multicolor liquid imaging suspension while moving the dark charge-exchange surface at a translational velocity of about 2.0 cm./sec. in the opposite direction. At the same time an electrical potential of +1.6 kilovolts was applied to the roller electrode and a 600 footcandle white light exposure was made through a positive color transparency to the liquid imaging suspension.

Observations:

The multicolor positive image formed on the paper covered roller electrode was of high density and good quality. For comparison purposes, a control image was formed using the identical imaging method with the exception that the dark charge-exchange surfaced electrode was held stationary. Average optical density measurements obtained from the test image and the control image are tabulated below.

| IMAGE | RED DENSITY | BLUE DENSITY | GREEN DENSITY |
|---|---|---|---|
| Control | .25 | .35 | .35 |
| Test | .50 | .65 | .75 |

It is believed that the improved image density and quality of the test image result from moving the dark charge-exchange surfaced electrode at a greater translational velocity than the image receiving electrode. Such movement continuously introduces fresh dark charge-exchange surface and increased amounts of fresh pigment particles at the imaging nip between the two electrodes.

The invention has been described in detail with particular reference to certain preferred embodiments thereof, but it will be understood that variations and modifications can be effected within the spirit and scope of the invention.

I claim:

1. A photoimmobilized electrophoretic recording process wherein electrically photosensitive particles, at least some of which bear a positive polarity electrostatic charge, are disposed between two spaced electrodes, subjected to an electric field, and imagewise exposed to activating radiation, one of said electrodes having on the surface thereof adjacent to said particles a uniform layer comprising an amount of a dark charge exchange material sufficient to provide a net change in charge polarity of at least a portion of said positive polarity particles upon electrical contact therewith in the presence of said field and in the absence of said radiation, said process comprising a. disposing said particles between said electrodes, and b. substantially simultaneously 1. establishing a potential difference between said electrodes to create said field such that at least a portion of said positive polarity particles move into electrical contact with said layer of dark charge exchange material, and 2. imagewise exposing said particles to activating radiation such that at least a portion of the exposed, positive polarity particles are immobilized at the surface of said layer of dark charge exchange material and at least a portion of the unexposed, positive polarity particles, upon electrical contact with said layer of dark charge exchange material, undergo a net change in charge polarity and are repelled therefrom, whereby an image is formed.

2. A photoimmobilized electrophoretic recording process as defined in claim 1 wherein said photosensitive particles are in an electrically insulating carrier liquid, a majority of said particles exhibiting a positive polarity electrostatic charge.

3. A photoimmobilized electrophoretic recording process as defined in claim 1 wherein said electrically photosensitive particles comprise a mixture of at least two differently colored photosensitive particles, each of which are primarily responsive to activating radiation of a different wavelength.

4. A photoimmobilized electrophoretic recording process as defined in claim 1 wherein said photosensitive particles are in a liquid carrier medium comprising a polymeric charge control agent dissolved in an electrically insulating liquid.

5. A photoimmobilized electrophoretic recording process as defined in claim 1 wherein said dark charge exchange material is inorganic.

6. A photoimmobilized electrophoretic recording process as defined in claim 1 wherein said dark charge exchange material is an electron acceptor material which (a) comprises at least one substituted aromatic ring and (b) has an electron acceptor strength greater than about −0.35.

7. A photoimmobilized electrophoretic recording process as defined in claim 1 wherein said layer of dark charge exchange material comprises a solid solution of a binder and a dark charge exchange material.

8. A photoimmobilized electrophoretic recording process wherein electrically photosensitive particles, at least some of which bear a positive polarity electrostatic charge, are disposed between two spaced electrodes, subjected to an electric field, and imagewise exposed to activating electromagnetic radiation, one of said electrodes having on the surface thereof adjacent to said particles a uniform layer comprising an amount of dark charge exchange material sufficient to provide a net change in charge polarity of at least a portion of said positive polarity particles upon electrical contact therewith in the presence of said field and in the absence of said radiation, and the other of said electrodes having on the surface thereof adjacent to said particles a blocking layer, said process comprising a. disposing said particles between said electrodes, and b. substantially simultaneously 1. establishing a potential difference between said electrodes to create said field such that at least a portion of said positive polarity particles move into electrical contact with said layer of dark charge exchange material and, 2. imagewise exposing said particles to activating radiation such that at least a portion of the exposed, positive polarity particles are immobilized at the surface of said layer of dark charge exchange material and at least a portion of the unexposed, positive polarity particles, upon electrical contact with said layer of dark charge exchange material, undergo a net change in charge polarity and are repelled therefrom, whereby an image is formed.

9. A photoimmobilized electrophoretic recording process which comprises:

a. providing a multiplicity of electrically photosensitive particles, at least some of which bear a positive polarity electrostatic charge, b. disposing said particles between two spaced electrodes, 1. one of said electrodes having on the surface thereof adjacent to said particles a uniform layer comprising an amount of a dark charge exchange material sufficient to provide a net change in charge polarity with at least a portion of said positive polarity particles upon electrical contact therewith in the presence of an electric field and in the absence of visible radiation, and the other of said electrodes having on the surface thereof adjacent said particles a blocking layer, and 2. one of said electrodes being at least partially transparent to visible radiation, c. substantially simultaneously 1. establishing a potential difference between said electrodes to create said field such that at least a portion of said positive polarity particles move into electrical contact with said layer of dark charge exchange material and 2. imagewise exposing said particles to visible radiation of such that at least a portion of the exposed, positive polarity particles are immobilized at the surface of said layer of dark charge exchange material and at least a portion of the unexposed, positive polarity particles, upon electrical contact with said layer of dark charge exchange material, undergo a net change in charge polarity and are repelled therefrom, whereby an image is formed.

10. A photoimmobilized electrophoretic recording process as defined in claim 9 wherein said photosensitive particles are in an electrically insulating carrier liquid, the majority of said particles exhibiting a positive polarity electrostatic charge.

11. A photoimmobilized electrophoretic recording process as defined in claim 9 wherein said electrically photosensitive particles comprise a mixture of at least two differently colored photosensitive particles, each of which are primarily responsive to visible radiation of a different wavelength.

12. A photoimmobilized electrophoretic recording process as defined in claim 9 wherein said photosensitive particles are in a liquid carrier medium comprising a polymeric charge control agent dissolved in an electrically insulating liquid.

13. A photoimmobilized electrophoretic recording process as defined in claim 9 wherein said dark charge exchange material is inorganic.

14. A photoimmobilized electrophoretic recording process as defined in claim 9 wherein said dark charge exchange material is an electron acceptor material which (a) comprises at least two fused aromatic rings, (b) has an electron acceptor strength greater than about −0.35, and (c) possesses at least one substituent bonded to an aromatic ring which substituent is a strong electron withdrawing group.

15. A photoimmobilized electrophoretic recording process wherein a liquid imaging suspension comprising a multiplicity of positive polarity, electrostatic charge-bearing electrically photosensitive particles dispersed in an electrically insulating carrier liquid is disposed between two spaced electrodes, subjected to an electric field, and imagewise exposed to visible light, one of said electrodes having on the surface thereof adjacent to said particles a uniform layer comprising an amount of a dark charge exchange material sufficient to provide a net change in charge polarity with at least a portion of said positive polarity particles upon electrical contact therewith in the presence of said field and in the absence of visible light, said process comprising substantially simultaneously a. establishing a potential difference between said electrodes to create said field such that at least a portion of said positive polarity particles move into electrical contact with said layer of dark charge exchange material and b. imagewise exposing said particles to visible light such that at least a portion of the exposed, positive polarity particles are immobilized at the surface of said layer of dark charge exchange material and at least a portion of the unexposed, positive polarity particles, upon electrical contact with said layer of dark charge exchange material, undergo a net change in charge polarity and are repelled therefrom, whereby a negative sense image of said imagewise exposure is formed by said particles on said layer of dark charge exchange material and a positive sense image of said imagewise exposure is formed on said blocking layer.

16. A photoimmobilized electrophoretic recording process wherein a liquid imaging suspension comprising a multiplicity of positive polarity, electrostatic charge-bearing electrically photosensitive particles dispersed in an electrically insulating carrier liquid is disposed between two spaced electrodes, subjected to an electric field, and imagewise exposed to visible light, one of said electrodes having on the surface thereof adjacent to said particles a uniform layer comprising an amount of a dark charge exchange material sufficient to provide a net change in charge polarity with at least a portion of said positive polarity particles upon electrical contact therewith in the presence of said field and in the absence of visible light, and the other of said electrodes having on the surface thereof adjacent to said particles a blocking layer, said process comprising substantially simultaneously a. establishing a potential difference between said electrodes to create said field such that at least a portion of said positive polarity particles move into electrical contact with said layer of dark charge exchange material and b. imagewise exposing said particles to visible light such that at least a portion of the exposed, positive polarity particles are immobilized at the surface of said layer of dark charge exchange material and at least a portion of the unexposed, positive polarity particles, upon electrical contact with said layer of dark charge exchange material, undergo a net change in charge polarity and are repelled therefrom, whereby a negative sense image of said imagewise exposure is formed by said particles on said layer of dark charge exchange material and a positive sense image of said imagewise exposure is formed on said blocking layer.

17. A photoimmobilized electrophoretic recording process which comprises:

a. providing a liquid imaging suspension comprising from about 0.01 to less than about 3.5 weight percent of electrically photosensitive particles, the majority of said particles exhibiting a positive polarity electrostatic charge, said particles comprising a mixture of at least two differently colored particles, each of which are primarily responsive to visible radiation of a different wavelength, b. disposing said suspension between two spaced electrodes, 1. one of said electrodes having on the surface thereof adjacent to said suspension a uniform layer comprising a solid solution of binder and amount of a dark charge exchange material sufficient to provide a net change in charge polarity of at least a portion of said positive polarity particles upon electrical contact therewith in the presence of said field and in the absence of visible radiation, and the other of said electrodes having on the surface thereof adjacent to said suspension a blocking layer, and 2. one of said electrodes being at least partially transparent to visible radiation, c. substantially simultaneously 1. establishing a potential difference between said electrodes to create said field such that at a portion of said positive polarity particles move into electrical contact with said layer of dark charge exchange material and 2. imagewise exposing said particles to visible radiation such that at least a portion of the exposed, positive polarity particles are immobilized at the surface of said layer of dark charge exchange material and at least a portion of the unexposed, positive polarity particles, upon electrical contact with the layer of dark charge exchange material, undergo a net change in charge polarity and are repelled therefrom, whereby a multicolor image is formed.

18. A photoimmobilized electrophoretic recording process as defined in claim 17 wherein said liquid imaging suspension contains a polymeric charge control agent.

19. A photoimmobilized electrophoretic recording process as defined in claim 17 wherein said layer of dark charge exchange material comprises a solid solution of a binder and an electron acceptor material and has a dry thickness of from about 5 to about 50 microns, said electron acceptor (a) comprising at least one substituted aromatic ring and (b) having an electron acceptor strength greater than about −0.35.

20. A photoimmobilized electrophoretic recording process wherein a liquid imaging suspension comprising an electrically insulating carrier liquid, a polymeric charge control agent dissolved therein, and from about 0.1 to less than about 3.5 percent by weight of predominantly positive polarity, electrostatic charge-bearing electrically photosensitive particles is disposed between two spaced electrodes, subjected to an electric field, and imagewise exposed to visible light, one of said electrodes being at least partially transparent and having a surface adjacent to said suspension bearing a uniform, at least partially transparent layer comprising an amount of a dark charge exchange material sufficient to provide a net change in charge polarity with at least a portion of said positive polarity particles in electrical contact therewith in the presence of an electric field and in the dark, and the other of said electrodes having a surface adjacent to said suspension bearing a blocking layer, said process comprising simultaneously:

a. establishing a potential difference between said electrodes to create said field such that at least a portion of said positive polarity particles move into electrical contact with said electrode bearing said layer of dark charge exchange material, and b. imagewise exposing said suspension to visible light such that at least a certain portion of the exposed, positive polarity particles are immobilized at the surface of said layer of dark charge exchange material, and at least a portion of the unexposed, positive polarity particles, upon electrical contact with the layer of dark charge exchange material, undergo a net change in charge polarity and are repelled therefrom, whereby a negative sense image of said imagewise exposure is formed by said particles on said layer of dark charge exchange material and a positive sense image of said imagewise exposure is formed on said blocking layer.

21. A photoimmobilized electrophoretic recording process as defined in claim 20 wherein said particles comprise a mixture of at least two differentially colored particles, each of which are primarily responsive to visible light of a different wavelength.

22. A photoimmobilized electrophoretic recording process as defined in claim 20 wherein said particles comprise a mixture of cyan, magenta, and yellow particles which are primarily responsive to red, green and blue light, respectively.

23. A photoimmobilized electrophoretic recording process as defined in claim 20 wherein said layer of dark charge exchange material (a) has a thickness of from about 5 to about 50 microns and (b) comprises a solid solution of a binder and at least 10 percent by weight of an electron acceptor material which (a) comprises at least two fused aromatic rings, (b) has an electron acceptor strength greater than about −0.35, and (c) possesses at least one substituent bonded to an aromatic ring which substituent is a strong electron withdrawing group.

24. A photoimmobilized electrophoretic recording process as defined in claim 20 wherein said layer of dark charge exchange material (a) has a thickness of from about 5 to about 50 microns and (b) comprises a solid solution of a binder and at least 10 percent by weight of a dark charge exchange material which (a) comprises at least two fused aromatic rings and (b) possesses at least two substituents bonded to an aromatic ring thereof which are strong electron withdrawing groups selected from the group consisting of nitro groups, cyano groups, dicyanoalkylene groups, cationic amino groups, and sulfone groups.

25. A photoimmobilized electrophoretic recording process as defined in claim 20 wherein said layer of dark charge exchange material (a) has a thickness of from about 5 to about 50 microns and (b) comprises a solid solution of a binder and at least 10 percent by weight of a dark charge exchange material which (a) comprises at least two fused aromatic rings and (b) possesses at least two substituents bonded to an aromatic ring thereof which are strong electron withdrawing groups selected from the group consisting of nitro groups and dicyanomethylene groups.

26. A photoimmobilized electrophoretic recording process as defined in claim 20 wherein said layer of dark charge exchange material comprises a solid solution of an electrically insulating binder and at least about 25 percent by weight of 2,4,7-trinitro-9-fluorenone.

27. A photoimmobilized electrophoretic recording process as defined in claim 20 wherein said layer of dark charge exchange material comprises a solid solution of an electrically insulating binder and a material selected from the group consisting of 2,4,7-trinitro-9-fluorenone; 9-(dicyanomethylene)-2,4,7-trinitrofluorene; 2,4,5,7-tetranitro-9-fluorenone; methyl-2,7-dinitro-9-fluorenone carboxylate; and 2-dicyanomethylene-1,3-indandione.

28. A photoimmobilized electrophoretic recording process as defined in claim 20 wherein said dark charge exchange material is inorganic.

29. A photoimmobilized electrophoretic recording process as defined in claim 20 wherein said electrode bearing said blocking layer is a roller and including the step of positioning said blocking layer of said roller into line contacct with said suspension as it is subjected to said field and imagewise exposure.

30. A photoimmobilized electrophoretic recording process as defined in claim 20 wherein said electrode bearing said blocking layer is a continuous web and including the step of positioning said blocking layer of said web into contact with said suspension as it is subjected to said field and imagewise exposure.

31. A photoimmobilized electrophoretic recording process as defined in claim 20 wherein said electrode bearing said blocking layer is a substantially flat plate and including the step of positioning said blocking layer of said plate into contact with said suspension as it is subjected to said field and imagewise exposure.

32. A photoimmobilized electrophoretic recording process wherein a liquid imaging suspension, comprising an electrically insulating carrier liquid and greater than about 0.1 percent by weight of electrically photosensitive particles at least some of which bear a positive polarity electrostatic charge, is disposed between two spaced electrodes, subjected to an electric field, and imagewise exposed to visible light, one of said electrodes being at least partially transparent and one of said electrodes having a surface adjacent to said suspension bearing a uniform layer comprising an amount of a dark charge exchange material sufficient to provide a net change in charge polarity with at least a portion of said positive polarity particles in electrical contact therewith in the presence of an electric field and in the dark, said dark charge exchange material being an electron acceptor material which (i) comprises at least one substituted aromatic ring, and (ii) has an electron acceptor strength greater than about −0.35, and the other of said electrodes having a surface adjacent to said suspension bearing a blocking layer, said process comprising substantially simultaneously:

a. establishing a potential difference between said electrodes to create said field such that at least a portion of said positive polarity particles move into electrical contact with said electrode bearing said layer of dark charge exchange material, and b. imagewise exposing said suspension to visible light such that at least a certain portion of the exposed, positive polarity particles are immobilized at the surface of said layer of dark charge exchange material, and at least a portion of the unexposed, positive polarity particles, upon electrical contact with the layer of dark charge exchange material, undergo a net change in charge polarity and are repelled therefrom.

33. A photoimmobilized electrophoretic recording process as defined in claim 32 wherein said layer of dark charge exchange material (a) has a thickness of from about 5 to about 50 microns and (b) comprises a solid solution of a binder and at least 10 percent by weight of the dark charge exchange material which (a) comprises two fused aromatic rings and (b) possesses at least two substituents bonded to an aromatic ring thereof which are strong electron withdrawing groups selected from the group consisting of nitro groups, cyano groups, and cyanoalkylene groups.

34. A photoimmobilized electrophoretic recording process as defined in claim 32 wherein said particles comprise a mixture of at least two differently colored particles, each of which are primarily responsive to visible light of a different wavelength.

35. A photoimmobilized electrophoretic recording process as defined in claim 32 wherein said layer of dark charge exchange material (a) has a thickness of from about 5 to about 50 microns and (b) comprises a solid solution of a binder and at least 10 percent by weight of a dark charge exchange material which (a) comprises at least two fused aromatic rings and (b) possesses at least two substituents bonded to an aromatic ring thereof which are strong electron withdrawing groups selected from the group consisting of nitro groups and dicyanomethylene groups.

36. A photoimmobilized electrophoretic recording process as defined in claim 32 wherein said layer of dark charge exchange material comprises a solid solution of an electrically insulating binder and at least about 25 percent by weight of 2,4,7-trinitro-9-fluorenone.

37. A photoimmobilized electrophoretic recording process as defined in claim 32 wherein said layer of dark charge exchange material comprises a solid solution of an electrically insulating binder and a material selected from the group consisting of 2,4,7-trinitro-9-fluorenone; 9-(dicyanomethylene)-2,4,7-trinitrofluorene; 2,4,5,7-tetranitro-9-fluorenone; methyl-2,7-dinitro-9-fluorenone carboxylate; and 2-dicyanomethylene-1,3-indandione.

38. A photoimmobilized electrophoretic recording process which comprises:

a. provising a liquid imaging suspension comprising an electrically insulating carrier liquid and greater than about 0.01 weight percent of electricaly photosensitive particles, at least some of said particles exhibiting a positive polarity electrostatic charge, said particles comprising a mixture of at least two differently colored particles, each of which are primarily responsive to visible radiation of a different wavelength, b. disposing said suspension between two spaced electrodes, 1. one of said electrodes having on the surface thereof adjacent to said suspension a uniform layer comprising a solid solution of binder and an amount of a dark charge exchange material sufficient to provide a net change in charge polarity of at least a portion of said positive polarity particles upon electrical contact therewith in the presence of said field and in the absence of visible radiation, said dark charge exchange material (i) having at least two aromatic rings and (ii) possessing at least two substituents bonded to an aromatic ring thereof which are strong electron withdrawing groups selected from the group consisting of cyano groups, dicyanoalkylene groups, and nitro groups, and the other of said electrodes having on the surface thereof adjacent to said suspension a blocking layer, and 2. one of said electrodes being at least partially transparent to visible radiation, c. substantially simultaneously 1. establishing a potential difference between said electrodes to create said field such that at a portion of said positive polarity particles move into electrical contact with said layer of dark charge exchange material and 2. imagewise exposing said particles to visible radiation such that at least a portion of the exposed, positive polarity particles are immobilized at the surface of said layer of dark charge exchange material and at least a portion of the unexposed, positive polarity particles, upon electrical contact with the layer of dark charge exchange material, undergo a net change in charge polarity and are repelled therefrom, whereby a multicolor image is formed.

* * * * *